US008862047B2

(12) United States Patent
Furushige et al.

(10) Patent No.: US 8,862,047 B2
(45) Date of Patent: Oct. 14, 2014

(54) SHEET CURL CORRECTION APPARATUS AND IMAGE FORMING APPARATUS

(75) Inventors: Katsuji Furushige, Osaka (JP); Keisuke Egawa, Osaka (JP); Noriaki Sumikura, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 689 days.

(21) Appl. No.: 13/069,948

(22) Filed: Mar. 23, 2011

(65) Prior Publication Data

US 2011/0236102 A1 Sep. 29, 2011

(30) Foreign Application Priority Data

Mar. 25, 2010 (JP) ..... 2010-070666
Aug. 31, 2010 (JP) ..... 2010-194517
Dec. 3, 2010 (JP) ..... 2010-270272

(51) Int. Cl.
*G03G 15/00* (2006.01)
*G03G 21/00* (2006.01)
*B65H 29/70* (2006.01)

(52) U.S. Cl.
CPC ..... *G03G 15/6576* (2013.01)
USPC ..... 399/406; 271/188

(58) Field of Classification Search
CPC ..... G03G 15/00; G03G 21/00; B65H 29/70
USPC ..... 399/406; 271/188
See application file for complete search history.

(56) References Cited

U.S. PATENT DOCUMENTS 5,084,731 A * 1/1992 Baruch ..... 399/406
5,392,106 A * 2/1995 Bigenwald et al. ..... 399/406
5,414,503 A * 5/1995 Siegel et al. ..... 399/406
5,761,600 A * 6/1998 Murata ..... 399/403
5,787,331 A * 7/1998 Ohkuma et al. ..... 399/406
5,927,713 A 7/1999 Driscoll et al.

(Continued)

FOREIGN PATENT DOCUMENTS

JP 06258906 A * 9/1994 ..... G03G 15/00
JP 09-011586 1/1997

(Continued)

OTHER PUBLICATIONS

Notice of Reasons for Rejection issued to JP Application No. 2010-194517 mailed Dec. 11, 2012.

(Continued)

*Primary Examiner* — Nguyen Ha
(74) *Attorney, Agent, or Firm* — Dilworth & Barrese, LLP.

(57) ABSTRACT

The present invention includes a supporting member that supports a first roller and a second roller, a first actuator that rotates the supporting member, a first gear that is connected to an end of second roller on the first actuator side, a second gear that is threadably engaged with the first gear, a third gear that rotates coaxially with the second gear, an input gear that threadably engages with the third gear, and a second actuator that transmits a rotational force to the input gear. The third rotation shaft extends in parallel in a first plane that includes the leading edge and the trailing edge of the nip, the first actuator rotates the supporting member between a first position at which the sheet is received from the leading edge of the nip and a second position at which the sheet is received from the trailing edge of the nip.

3 Claims, 21 Drawing Sheets

(56) References Cited

U.S. PATENT DOCUMENTS

| | | | | |
|---|---|---|---|---|
| 5,933,698 | A * | 8/1999 | Muramatsu | 399/406 |
| 6,002,913 | A * | 12/1999 | Pawlik et al. | 399/406 |
| 6,259,888 | B1 * | 7/2001 | Kazama et al. | 399/406 |
| 7,383,017 | B2 * | 6/2008 | Ushio | 399/406 |
| 7,697,884 | B2 * | 4/2010 | Tateishi | 399/406 |
| 2005/0063747 | A1 * | 3/2005 | Ushio | 399/406 |
| 2006/0140696 | A1 * | 6/2006 | Uehara et al. | 399/406 |
| 2008/0061488 | A1 * | 3/2008 | Keyes et al. | 270/1.01 |
| 2008/0159795 | A1 * | 7/2008 | Mori et al. | 399/406 |
| 2008/0253780 | A1 * | 10/2008 | Nishimura et al. | 399/27 |
| 2009/0212484 | A1 | 8/2009 | Kawaguchi et al. | |

FOREIGN PATENT DOCUMENTS

| | | | | |
|---|---|---|---|---|
| JP | H09-011586 | | 1/1997 | |
| JP | 09062145 | A * | 3/1997 | G03G 15/00 |
| JP | H09-200401 | | 7/1997 | |
| JP | 10-231061 | | 9/1998 | |
| JP | 10231061 | A * | 9/1998 | B65H 29/70 |
| JP | 2001-109293 | | 4/2001 | |
| JP | 2003-012215 | | 1/2003 | |
| JP | 2004-26419 | | 1/2004 | |
| JP | 2006-232516 | | 9/2006 | |
| JP | 2009-29554 | | 2/2009 | |
| JP | 2009-202952 | | 9/2009 | |
| JP | 2009288452 | A * | 12/2009 | G03G 21/00 |
| JP | 2010002738 | A * | 1/2010 | G03G 21/00 |

OTHER PUBLICATIONS

Notice of Reasons for Rejection issued to JP Application No. 2013-237513, mailed Jul. 22, 2014.

* cited by examiner

SHEET CURL CORRECTION APPARATUS AND IMAGE FORMING APPARATUS

This application is based on and claims the benefit of priority from Japanese Patent Application Nos. 2010-070666, 2010-194517 and 2010-270272, respectively filed on 25 Mar. 2010, 31 Aug. 2010 and 3 Dec. 2010, the contents of which are incorporated herein by reference.

BACKGROUND OF THE INVENTION

1. Field of the Invention

The present invention relates to a sheet curl correction apparatus for correcting a curl produced in a sheet such as paper on which an image is formed in an image forming apparatus such as a copying machine, a printer, a facsimile, and the like, and to an image forming apparatus including the sheet curl correction apparatus.

2. Related Art

In an image forming apparatus such as a copying machine, a toner image is formed on a sheet, such as paper, in an image forming unit such as a photoreceptor drum and the like, and then the toner image is fixed to the sheet by application of heat and pressure in a fixing part. Consequently, a curl tends to be produced in the sheet after passing through the fixing part. When a sheet with this type of curl is discharged as it is, a space is produced between a plurality of sheets due to the curl when the sheets are stacked in a discharging tray. This phenomenon poses problems in relation to sheet handling such as an adverse effect on storage performance or the sheets becoming disarrayed.

A sheet curl correction apparatus has been applied in which the curl in the sheet is corrected by passing the sheet between a pair of curl correction rollers.

In this connection, the curl in a sheet includes "upward curl" in which a distal end of the sheet is bent towards an upper surface of the sheet and "downward curl" in which the distal end of the sheet is bent towards a lower surface of the sheet. There is a need for a curl correction apparatus that corrects both upward curl and downward curl.

To respond to this need, a curl correction apparatus has been proposed in which the orientation of the pair of curl correction rollers is interchanged by rotating a curl correction unit including a supporting member for rotatably supporting the pair of curl correction rollers, such that a direction of curl correction applied by the pair of curl correction rollers is switchable.

Furthermore, a curl correction apparatus has been proposed that includes a curl correction unit that has a supporting member for rotatably supporting three curl correction rollers, and a detection means that is disposed upstream of the curl correction unit in a direction of sheet feeding and detects a direction of curl in the fed sheet (upward curl or downward curl). The curl correction apparatus controls the curl correction unit to rotate based on the detection of the curl performed by the curl detection means such that the three curl correction rollers can vary directions of curl correction.

However, there is a demand for further downsizing of the curl correction apparatus.

In addition, this type of image forming apparatus does not simply print an image only on one side of a sheet of paper, and includes a duplex printing function that enables printing on both sides. A duplex printing function is realized by inverting a sheet of paper that has been printed on one side without discharging, and then printing on the other side.

This type of image forming apparatus may be incapable of feeding paper by a discharging roller or the like when a curl is produced in a sheet of paper inside the image forming apparatus, and a paper jam may be caused. Consequently, some image forming apparatus includes a curl correction device to remove a curl produced in a sheet of paper.

In addition, there is a technique of preventing a curl produced in a sheet of paper without using a curl correction apparatus. More specifically, a contact point of a pressure roller lying on a common tangent line between a fixing roller and a downstream roller is disposed relative to the fixing roller more downstream of a pressure contact part than a line connecting rotational centers of the fixing roller and the pressure roller. Accordingly, the technique adjusts a shape of the pressure part so as to regulate the curl in the sheet of paper.

This technique allows not only formation of at least two nips in mutually different directions in the pressure contact part, but also adjustment of a length of a nip that lies downstream in a direction of feeding the sheet of paper. Accordingly, it may be possible to regulate the curl in the sheet of paper without a curl correction apparatus, or the like.

The apparatuses used in the conventional techniques described above have an object of suppressing a curl in a sheet of paper without a curl correction apparatus, or the like. However, since there is a situation in which a curl occurs depending on a type of paper, a type of toner, or a method of duplex printing, a curl correction apparatus is required to improve the printing quality.

Some copying apparatus often uses sheets of cut paper that are cut to a predetermined size instead of a roll of paper. Consequently, although a sheet of paper does not curl at the commencement of the image forming process, curling may occur when the sheet of paper passes through the fixing apparatus. When the image forming apparatus is a copying apparatus, for example, an image is formed on a sheet of paper by fixing a toner image with a fixing apparatus after an image transfer apparatus transfers the toner image to the sheet of paper. Generally, the fixing apparatus is composed of a heat roller and a pressure roller, and the toner is fused and fixed to the sheet of paper by application of heat and pressure to the toner. In this manner, the sheet of paper tends to curl in the fixing apparatus due to heating and pressing of the sheet of paper, and a curl correction apparatus may be required downstream of the fixing apparatus to realize high quality printing.

In this connection, there is a technique in which a curl correction apparatus that decurls (corrects a curl) duplex-printed paper enables the direction of decurling to be switched (for example, a rotary decurling apparatus). However, current techniques do not enable a sufficient time for switching the decurl direction after image data stored in a video buffer (a buffer for retracting image data temporarily before image forming) is sent from the video buffer to an engine control unit (after starting image extraction).

Although calculation of a coverage rate of a sheet of paper is adopted to determine the decurl direction, it is only after image data is sent to the engine control unit that the coverage rate is acquired. Consequently, when multiple print runs are performed, the first copy is outputted as a sample, and then the curl correction apparatus is controlled during the second and subsequent runs.

Therefore, a problem arises in that a correct decurl process is not executed in the first print run when the multiple print runs are performed and the printing quality of the first print run cannot be improved.

SUMMARY OF THE INVENTION

The present invention has an object of providing a sheet curl correction apparatus that enables downsizing of a curl correction unit.

The present invention has an object of providing a sheet curl correction apparatus that executes an accurate decurl process from the first copy even when multiple print runs are performed, and that enables an improvement in the printing quality of a larger number of print runs.

The present invention has an object of providing an image forming apparatus including the sheet curl correction apparatus.

The present invention relates to a sheet curl correction apparatus for correcting a curl in a sheet by passing the sheet between rollers. The sheet curl correction apparatus includes a first roller, a second roller, a supporting member, a first actuator, a first gear, a second gear, a third gear, an input gear and a second actuator. The first roller rotates about a first rotation shaft and is formed resiliently deformable. The second roller rotates about a second rotation shaft that is parallel to the first rotation shaft and is formed from a harder material than the first roller. The supporting member supports the first roller and the second roller. The first actuator rotates the supporting member about a third rotation shaft. The first gear is connected to an end of the second roller on a side closer to the first actuator. The second gear engages with the first gear. The third gear rotates coaxially with the second gear. The input gear engages with the third gear.

The second actuator transmits a rotational force to the input gear. The second roller is brought into pressure contact with the first roller to bite thereinto such that a curved nip path through which the sheet passes is formed between the first roller and the second roller. The third rotation shaft extends parallel to an axial direction of the first rotation shaft in a first plane that includes a leading edge and a trailing edge of the nip. The first actuator causes the supporting member to rotate between a first position at which the sheet moving towards the nip is received from the leading edge of the nip and a second position at which the sheet moving towards the nip is received from the trailing edge of the nip.

It may be preferable that the sheet curl correction apparatus further includes an outer gear for rotatably supporting the input gear and having a peripheral surface formed with gear teeth, the outer gear is unrotatably connected to the supporting member, and the first actuator is connected to the outer gear.

It may be preferable that the third rotation shaft is formed along a line of intersection between the first plane and a second plane that includes the first rotation shaft and the second rotation shaft.

The present invention relates to an image forming apparatus that includes: an image forming unit for forming an image on a sheet; a fixing part for thermally fixing the image to the sheet; and a sheet curl correction apparatus for correcting curl in the sheet on which the image is fixed. The sheet curl correction apparatus includes: a first roller rotating about a first rotation shaft and formed resiliently deformable; a second roller rotating about a second rotation shaft that is parallel to the first rotation shaft and formed from a harder material than the first roller; a supporting member that supports the first roller and the second roller; a first actuator that rotates the supporting member about a third rotation shaft; a first gear connected to an end of the second roller on a side closer to the first actuator; a second gear that engages with the first gear; a third gear that rotates coaxially with the second gear; an input gear that engages with the third gear; and a second actuator that transmits a rotational force to the input gear. The second roller is brought into pressure contact with the first roller to bite thereinto such that a curved nip through which the sheet passes is formed between the first roller and the second roller. The third rotation shaft extends parallel to an axial direction of the first rotation shaft in a first plane that includes a leading edge and a trailing edge of the nip. The first actuator causes the supporting member to rotate between a first position at which the sheet moving towards the nip is received from the leading edge of the nip and a second position at which the sheet moving towards the nip is received from the trailing edge of the nip.

The present invention relates to a sheet curl correction apparatus that corrects curl in a sheet by passing the sheet between a first roller and a second roller. The apparatus includes: a curl correction unit including the first roller and the second roller, and a supporting member that rotatably supports the first roller and the second roller and is rotatable about a third rotation shaft that is parallel to a first rotation shaft of the first roller and a second rotation shaft of the second roller, the curl correction unit causing a direction of curl correction through the first roller and the second roller to switch accompanying rotation of the supporting member; a first actuator that drives the supporting member to rotate; and a second actuator that drives at least one of the first roller and the second roller. The first actuator and the second actuator are disposed on a fixing member on the sheet curl correction apparatus main portion that rotatably supports the curl correction unit, and are disposed on one end of the first rotation shaft of the first roller and the second rotation shaft of the second roller in the curl correction unit. The first actuator and the second actuator comprise a single drive motor that is switchable between a positive rotation direction and a reverse rotation direction.

It may be preferable that the first roller is formed resiliently deformable, and the second roller rotates about the second rotation shaft parallel to an axial direction of the first rotation shaft and is formed from a harder material than the first roller, the second roller includes: a first gear that is connected to an end of the second roller on a side closer to the first actuator; a second gear engaging with the first gear; a third gear that rotates coaxially with the second gear; an input gear engaging with the third gear; and the second actuator that transmits a rotational force to the input gear, the second roller is brought into pressure contact with the first roller to bite thereinto such that a curved nip path through which the sheet passes is formed between the first roller and the second roller.

It may be preferable that the sheet curl correction apparatus further includes an outer gear unrotatably connected to the supporting member, the curl correction unit includes the input gear that is fixed to the third rotation shaft, the first actuator drives the supporting member to rotate through the outer gear, and the second actuator drives at least one of the first roller and the second roller to rotate through the input gear.

It may be preferable that the third rotation shaft extends in parallel in an axial direction of the first rotation shaft within a first plane that includes a leading edge and a trailing edge of the nip, and the first actuator causes the supporting member to rotate between a first position at which the sheet moving towards the nip is received from the leading edge of the nip and a second position at which the sheet moving towards the nip is received from the trailing edge of the nip.

It may be preferable that the curl correction unit includes a sheet introduction path that guides the sheet into the nip between the first roller and the second roller and a sheet discharge path that guides the sheet out of the nip between the first roller and the second roller, and the sheet introduction path and the sheet discharge path are configured to be rotatable accompanying rotation of the supporting member of the curl correction unit.

The present invention relates to an image forming apparatus, which includes: an image forming unit forming an image on a sheet; and a sheet curl correction apparatus for correcting curl of the sheet on which the image is formed by the image forming unit.

The present invention is the image forming apparatus including the image forming unit for forming an image based on image data processed on a page-by-page basis. The image forming apparatus according to the present invention prints an image per page formed in the image forming unit on one surface of the sheet of paper, and then prints an image per page on the other surface of the same sheet of paper, and discharges the sheet of paper. The image per page corresponds to one surface (one page) of one sheet of paper.

The image forming apparatus according to the present invention includes the curl correction apparatus. The curl correction apparatus corrects a curl produced in a sheet of paper on which an image is formed by the image forming unit, and can switch to a first condition in which the curl is corrected by curving the sheet of paper towards one surface of the sheet of paper and a second condition in which the curl is corrected by curving the sheet of paper towards the other surface of the sheet of paper. In other words, the curl correction apparatus can correct the curl by curving the sheet of paper from a front surface side towards a reverse surface side, and conversely, by curving the sheet of paper from the reverse surface side to the front surface side.

The image forming apparatus according to the present invention executes the following process before the image forming unit forms an image.

(1) Calculate a coverage rate for one surface of the sheet of paper and a coverage rate for the other surface of the sheet of paper based on the image data.

(2) Determine whether to switch the curl correction apparatus to the first condition or to the second condition based on the coverage rates calculated in (1) above. The determination is performed by comparing the coverage rates between one surface with the other surface. This determination predicts in which direction curling of the sheet of paper after printing will occur. The prediction can be executed by the amount of coverage rate or setting a predetermined threshold value.

(3) Switch the curl correction apparatus to one of the first condition and the second condition based on the determination result determined in (2) above.

After the curl correction apparatus is switched to one of the first condition and the second condition, the curl correction apparatus executes a curl correction process as usual.

In the present invention, "coverage rate (image density)" includes not only a case in which a proportion of a surface area on which an image is actually formed corresponds to the surface area of an image formable region on a sheet of paper (general coverage rate), but also includes a case in which the ratio of the surface area on which the image is actually formed corresponds to a surface area of a part of the image formable region (for example, a region in a part upstream of the feeding direction of the sheet of paper of the image formable region).

In this manner, according to the image forming apparatus of the present invention, the coverage rate is calculated prior to the image forming unit forming the image, the switching configuration of the curl correction apparatus is determined, and the curl correction apparatus is switched to one of the first condition and the second condition based on the determination result. Therefore, even when multiple copies are printed, printing processing can be executed by execution of a correct decurl process from the first copy. Thus, in the present invention, there is no need to output the first copy as a sample, and printing with improved printing quality can be executed from the printing of the first copy.

It may be preferable that the image forming apparatus further includes: a main control unit for controlling overall operation of the image forming apparatus; and a printing control unit for controlling printing operation executed by the image forming unit, the calculation unit is disposed in the main control unit, the determination unit and the switching unit are disposed in the printing control unit, and the main control unit transmits a printing instruction to indicate printing of an image per page for each surface of the sheet of paper and the coverage rate calculated by the calculation unit to the printing control unit.

According to the present invention, the main control unit sends the printing instruction together with the coverage rate to the printing control unit. Therefore, the processing load is separated between the main control unit and the printing control unit. The printing control unit controls the printing operation of the image forming unit based on the printing instruction, while the curl correction apparatus executes control based on the coverage rate received from the main control unit.

It may be preferable that the image forming apparatus further includes an image data storage unit for temporarily storing the image data that is to be sent to the image forming unit, and the calculation unit calculates the coverage rate based on the image data stored in the image data storage unit.

According to the present invention, the calculation unit can calculate the coverage rate based on the image data stored in the image data storage unit. The image data storage unit (for example, video buffer) is a storage unit that is generally provided in a conventional image forming apparatus. If the image data is dot counted, for example, to calculate a coverage rate when the image data is stored into the storage unit, the coverage rate can be calculated in a simple configuration and process. Accordingly, it is possible to reduce the processing load on the image forming apparatus.

It may be preferable that the printing control unit transmits an image data send instruction for requesting to send the image data temporarily stored in the image data storage unit to the main control unit based on the printing instruction, and the determination unit executes the determination prior to the printing control unit completing sending of all image data send instructions related to the one surface and the other surface of the sheet of paper.

According to the present invention, the determination related to the curl correction apparatus is executed prior to completion of sending all image data send instructions (for example PVSYNC) related to one surface and the other surface of the sheet of paper. Therefore, the curl correction apparatus can be controlled prior to executing a printing operation for at least one surface (front surface or reverse surface) during duplex printing. Therefore, since the curl correction apparatus can be controlled prior to commencement of the printing operation for at least one surface during duplex printing, a problem does not arise in that timing to control the curl correction apparatus is behind time.

It may be preferable in the image forming apparatus of the present invention that the main control unit transmits print run information related to a number of copies of printed matter to the printing control unit, and when the print run information indicates at least two copies, the printing control unit controls printing operation for a second copy and subsequent copies based on a coverage rate of a first copy.

According to the present invention, when the print run information indicates two copies or more, the printing control unit controls the printing operation related to the second copy and subsequent copies based on the coverage rate of the first copy. According to the present invention, the apparatus stores the printing conditions of the first copy on the premise that the printing of the second copy and subsequent copies will have the same coverage rate as the first copy (reflects the coverage rate), and executes the printing operation by controlling the curl correction apparatus to operate in the same manner as the first copy. Therefore, print processing can be executed for the second copy and subsequent copies using the same configuration as the first copy that is printed with high quality.

It may be preferable in the image forming apparatus of the present invention that the main control unit transmits job information related to a printing job unit to the printing control unit, and when another job information is received by interruption during execution of printing, the printing control unit temporarily suspends a job in progress and stores information about a coverage rate and a condition of the curl correction apparatus related to the job in progress, so that the printing control unit resumes the suspended job based on the stored information related to the coverage rate and the condition of the curl correction apparatus after executing printing based on the other job information.

According to the present invention, when information for another job is received by interruption, the information related to the coverage rate or the condition of the curl correction apparatus of a job currently being printed is stored, and the suspended printing is recommenced using the stored information. As a result, when recommencing printing, the present invention can recommence printing in the condition prior to suspension without the need to recalculate the coverage rate related to the job prior to suspension, and therefore can continuously execute printing processing in the condition prior to suspension when printing is recommenced.

According to the present invention, the sheet curl correction apparatus can be provided that enables downsizing of the curl correction unit.

Furthermore, according to the present invention, the image forming apparatus including the sheet curl correction apparatus can be provided.

According to the present invention, prior to forming the image by the image forming unit, a coverage rate for image data can be calculated, the transition configuration of the curl correction apparatus can be determined, and the curl correction apparatus can be switched to one of the first condition and the second condition based on the determination result. As a result, according to the present invention, even when multiple copies are printed, print processing can be performed by executing a correct decurl process from the first copy, and therefore printing quality can be improved from the printing of the first copy.

DETAILED DESCRIPTION OF THE INVENTION

First Embodiment

A first embodiment of an image forming apparatus according to the present invention will be described below making reference to the figures.

Figure 1:
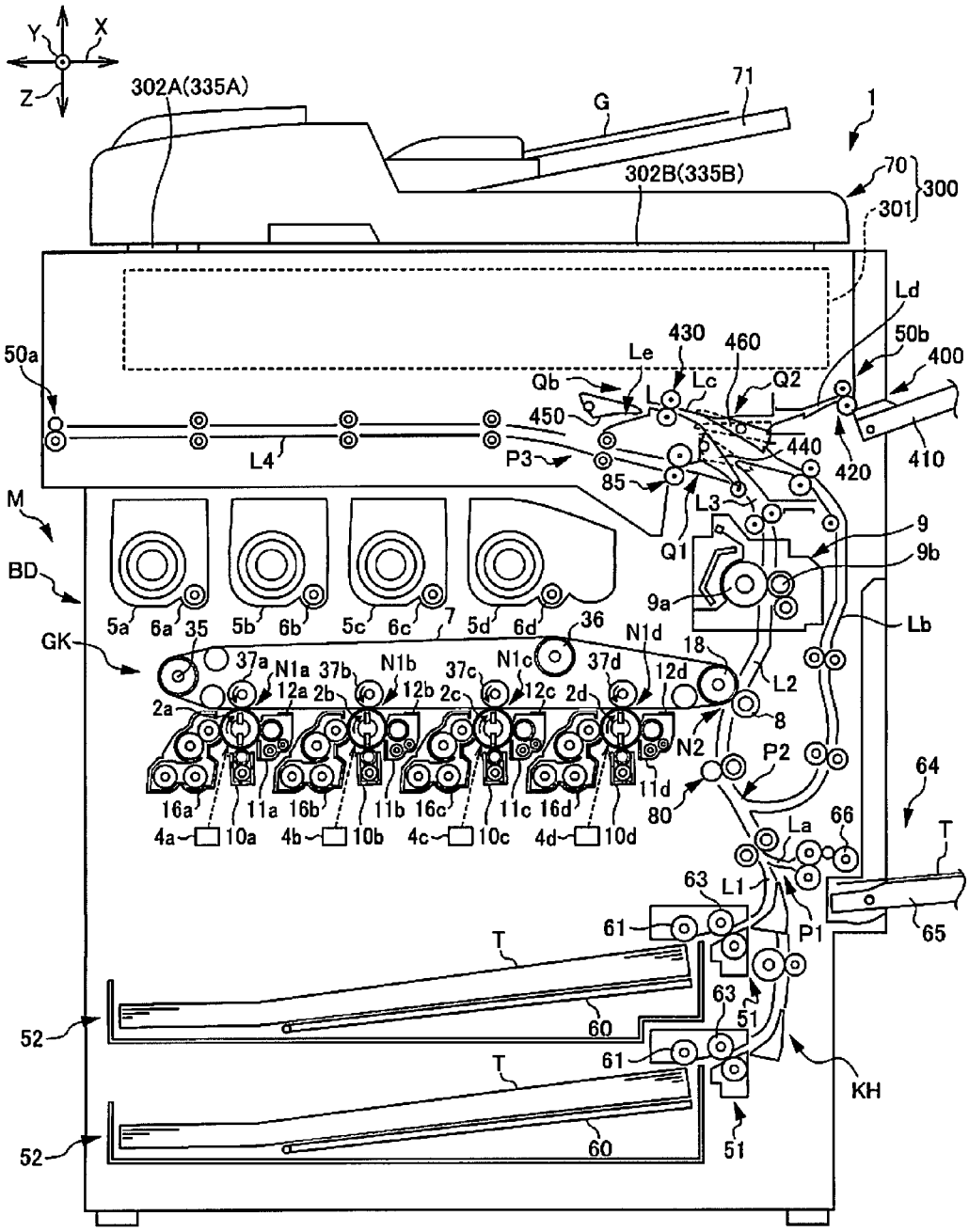
FIG. 1 illustrates the configuration of constituent elements of a copying machine 1 according to a first embodiment of the present invention.

The overall structure of a copying machine 1 will be described as an example of the image forming apparatus in the first embodiment making reference to FIG. 1. FIG. 1 illustrates the configuration of each constituent element of the copying machine 1 according to the first embodiment.

As illustrated in FIG. 1, the copying machine 1 as an example of an image forming apparatus includes an image reading apparatus 300 disposed at an upper portion of the copying machine 1 in a vertical direction Z, and the apparatus main unit M. The apparatus main unit M, which is disposed on a lower side in the vertical direction Z of the copying machine 1, forms a toner image on a sheet of paper T as a sheet (copying member) based on image information read by the image reading apparatus 300.

In the description of the copying machine 1, a sub-scanning direction X of the image reading apparatus 300 denotes a "left-right direction" of the copying machine 1, and a main scanning direction Y of the image reading apparatus 300 (a direction perpendicular to FIG. 1, refer to FIG. 2) denotes a "longitudinal direction" of the copying machine 1. A vertical direction Z of the copying machine 1 is orthogonal to the sub-scanning direction X and the main scanning direction Y.

Firstly, the image reading apparatus 300 will be described.

As illustrated in FIG. 1, the image reading apparatus 300 includes a reader unit 301 for reading an image of a document G, and a document feed part 70 that is disposed above the reader unit 301 and feeds the document G to the reader unit 301.

An upper side of the reader unit 301 includes a first reader surface 302A and a second reader surface 302B. The document G is fed from the document feed part 70 onto the first reader surface 302A. A document G is mounted by a user onto the second reader surface 302B.

The document feed part 70 is connected with the reader unit 301 by a connecting part (not illustrated) so as to be openable and closeable. The document feed part 70 includes a document mounting part 71 on its upper side and a feed roller (not illustrated) internally. The document feed part 70 includes a function of covering the first reader surface 302A and the second reader surface 302B of the reader unit 301.

The first reader surface 302A is a reader surface that is used when a document G fed by the document feed part 70 is read. The first reader surface 302A is formed along an upper surface of a first contact glass 335A. The first reader surface 302A is positioned in proximity to the left surface of the reader unit 301.

The second reader surface 302B is a reader surface that is used when a document G is read without using the document feed part 70. The second reader surface 302B is formed along an upper surface of a second contact glass 335B. The second reader surface 302B is disposed more to the right than the first reader surface 302B, and spans the majority of the sub-scanning direction X of the reader unit 301.

The first reader surface 302A and the second reader surface 302B extend in the sub-scanning direction X and the main scanning direction Y.

When the document G fed by the document feed part 70 is read, it is mounted on the document mounting part 71. The document G mounted on the document mounting part 71 is fed to the first reader surface 302A of the reader unit 301 by the feeding roller provided inside the document feed part 70. The document G is fed onto the first reader surface 302A by the document feed part 70, and the image formed on the front surface of the document G is read by the reader unit 301.

When the document feed part 70 is open, the document G is mounted by a user on the second reader surface 302B. The image on the document G mounted on the second reader surface 302B is read by the reader unit 301.

Next, the apparatus main unit M will be described.

The apparatus main unit M includes: an image forming unit GK that forms a predetermined toner image on a sheet of paper T based on predetermined image information, and a paper feeding/discharging unit KH that feeds the sheet of paper T to the image forming unit GK and discharges the sheet of paper T on which a toner image is formed.

The external shape of the apparatus main unit M is composed of a cabinet BD as a housing.

As illustrated in FIG. 1, the image forming unit GK includes: photoreceptor drums 2*a*, 2*b*, 2*c*, and 2*d* as image supporting bodies (photoreceptors); charging parts 10*a*, 10*b*, 10*c*, and 10*d*; laser scanner units 4*a*, 4*b*, 4*c*, and 4*d* as exposure units; developing units 16*a*, 16*b*, 16*c*, and 16*d*; toner cartridges 5*a*, 5*b*, 5*c*, and 5*d*; toner feeding parts 6*a*, 6*b*, 6*c*, and 6*d*; drum cleaning parts 11*a*, 11*b*, 11*c*, and 11*d*; static eliminators 12*a*, 12*b*, 12*c*, and 12*d*; an intermediate image transfer belt 7; primary image transfer rollers 37*a*, 37*b*, 37*c*, and 37*d*; a secondary image transfer roller 8; an opposing roller 18; and the fixing part 9.

As illustrated in FIG. 1, the paper feeding/discharging unit KH includes a paper feeding cassette 52, a manual feeding unit 64, a paper feed path L for a sheet of paper T, a pair of resist rollers 80, a pair of curl correction rollers 85 composing a part of a curl correction apparatus 500 (to be described later), a first discharging part 50*a*, and a job separator 400 including a second discharging part 50*b*. The paper feed path L as will be described later is an assembly including a first paper feed path L1, a second paper feed path L2, a third paper feed path L3, a fourth paper feed path L4, a manual paper feed path La, a return paper feed path Lb, a reversing paper feed path Lc, a sub paper feed path Ld, and a junction paper feed path Le.

Components of the image forming unit GK and the paper feeding/discharging unit KH will be described in detail hereinafter.

First, a description is provided for the image forming unit GK.

In the image forming unit GK, charging by the charging parts 10*a*, 10*b*, 10*c* and 10*d*, exposure by the laser scanner units 4*a*, 4*b*, 4*c* and 4*d*, development by the developing units 16*a*, 16*b*, 16*c* and 16*d*, primary image transfer by the intermediate image transfer belt 7 and the primary image transfer rollers 37*a*, 37*b*, 37*c* and 37*d*, static elimination by the static eliminators 12*a*, 12*b*, 12*c* and 12*d*, and cleaning by the drum cleaning parts 11*a*, 11*b*, 11*c* and 11*d*, are performed sequentially on surfaces of the photoreceptor drums 2*a*, 2*b*, 2*c* and 2*d*, from an upstream side to a downstream side.

In addition, secondary image transfer by the intermediate image transfer belt 7, the secondary image transfer roller 8 and the opposing roller 18, and fixation by the fixing part 9 are performed in the image forming unit GK.

Each of the photoreceptor drums 2*a*, 2*b*, 2*c*, and 2*d* is composed of a cylindrically shaped member and functions as a photoreceptor or an image supporting unit. Each of the photoreceptor drums 2*a*, 2*b*, 2*c*, and 2*d* is disposed rotatable in a direction of an arrow, about an axis that extends in a direction orthogonal to a direction of movement of the intermediate image transfer belt 7. An electrostatic latent image is formed on a surface of each of the photoreceptor drums 2*a*, 2*b*, 2*c*, and 2*d*.

Each of the charging parts 10*a*, 10*b*, 10*c*, and 10*d* is disposed to face a surface of each of the photoreceptor drums 2*a*, 2*b*, 2*c*, and 2*d*. Each of the charging parts 10*a*, 10*b*, 10*c*, and 10*d* negatively (negative polarity) or positively (positive polarity) charges a surface of each of the photoreceptor drums 2*a*, 2*b*, 2*c*, and 2*d* uniformly.

Each of the laser scanner units 4*a*, 4*b*, 4*c*, and 4*d*, which functions as an exposure unit, is disposed to be spaced apart from a surface of each of the photoreceptor drums 2*a*, 2*b*, 2*c*, and 2*d*. Each of the laser scanner units 4*a*, 4*b*, 4*c*, and 4*d* is configured to include a laser light source, a polygonal mirror, a polygonal mirror driving motor and the like, which are not illustrated.

Each of laser scanner units 4*a*, 4*b*, 4*c*, 4*d* scans and exposes the front surface of each of the photoreceptor drums 2*a*, 2*b*, 2*c*, 2*d* based on the image information related to the image read by the reader unit 301. An electric charge of an exposed part of the surface of each of the photoreceptor drums 2*a*, 2*b*, 2*c*, and 2*d* is removed, which are scanned and exposed by the laser scanner units 4*a*, 4*b*, 4*c*, and 4*d*, respectively. In this way, an electrostatic latent image is formed on the surface of each of the photoreceptor drums 2*a*, 2*b*, 2*c*, and 2*d*.

The developing units 16*a*, 16*b*, 16*c*, and 16*d* are disposed to correspond to the photoreceptor drums 2*a*, 2*b*, 2*c*, and 2*d*, respectively, facing corresponding surfaces of the photoreceptor drums 2*a*, 2*b*, 2*c*, and 2*d*. Each of the developing units 16*a*, 16*b*, 16*c*, and 16*d* forms a color toner image on a surface of each of the photoreceptor drums 2*a*, 2*b*, 2*c*, and 2*d* by depositing toners of various colors on an electrostatic latent image formed on the surface of each of the photoreceptor drums 2*a*, 2*b*, 2*c*, and 2*d*. The developing units 16*a*, 16*b*, 16*c*, and 16*d* correspond to four colors of yellow, cyan, magenta, and black, respectively. Each of the developing units 16*a*, 16*b*, 16*c*, and 16*d* is configured to include a developing roller disposed to face a surface of each of the photoreceptor drums 2*a*, 2*b*, 2*c*, and 2*d* and an agitating roller for agitating toner.

The toner cartridges 5*a*, 5*b*, 5*c*, and 5*d* are provided corresponding to the developing units 16*a*, 16*b*, 16*c*, and 16*d*, respectively, and store the toners of different colors that are supplied to the developing units 16*a*, 16*b*, 16*c*, and 16*d*, respectively. The toner cartridges 5*a*, 5*b*, 5*c*, and 5*d* store toners of yellow, cyan, magenta, and black respectively.

The toner feeding parts 6*a*, 6*b*, 6*c*, and 6*d* are provided to correspond to the toner cartridges 5*a*, 5*b*, 5*c*, and 5*d*, respectively; and the toner feeding parts 6*a*, 6*b*, 6*c*, and 6*d* supply the toners of the respective colors stored in the toner cartridges 5*a*, 5*b*, 5*c*, and 5*d* to the developing units 16*a*, 16*b*, 16*c*, and 16*d*, respectively. The toner feeding parts 6*a*, 6*b*, 6*c*, and 6*d* are connected with the developing units 16*a*, 16*b*, 16*c*, and 16*d*, respectively, via toner feeding paths (not illustrated).

Toner images of respective colors formed on the photoreceptor drums 2*a*, 2*b*, 2*c*, and 2*d* undergo primary transfer in sequence onto the intermediate image transfer belt 7. The intermediate image transfer belt 7 goes around a driven roller 35, the opposing roller 18 of a driving roller, a tension roller 36 and the like. Since the tension roller 36 biases the intermediate image transfer belt 7 from inside to outside, a predetermined tension is applied to the intermediate image transfer belt 7.

Primary transfer rollers 37*a*, 37*b*, 37*c*, and 37*d* are disposed opposite to the photoreceptor drums 2*a*, 2*b*, 2*c*, and 2*d*, respectively while the intermediate image transfer belt 7 is interposed therebetween.

Parts of the intermediate image transfer belt 7 are sandwiched between the primary image transfer rollers 37*a*, 37*b*, 37*c*, and 37*d* and the photoreceptor drums 2*a*, 2*b*, 2*c*, and 2*d*. The sandwiched parts are pressed against surfaces of the photoreceptor drums 2*a*, 2*b*, 2*c*, and 2*d*. Primary image transfer nips N1*a*, N1*b*, N1*c*, and N1*d* are formed between the photoreceptor drums 2*a*, 2*b*, 2*c*, and 2*d* and the primary image transfer rollers 37*a*, 37*b*, 37*c*, and 37*d*, respectively. At the primary image transfer nips N1*a*, N1*b*, N1*c*, and N1*d*, toner images of the respective colors developed on the photoreceptor drums 2*a*, 2*b*, 2*c*, and 2*d* undergo primary transfer in sequence onto the intermediate image transfer belt 7. In this manner, a full-color toner image is formed on the intermediate image transfer belt 7.

A primary image transfer bias is applied to each of the primary image transfer rollers 37*a*, 37*b*, 37*c*, and 37*d* by a primary image transfer bias application part (not illustrated). Due to the primary image transfer bias, a toner image of each color formed on each of the photoreceptor drums 2*a*, 2*b*, 2*c*, and 2*d* is transferred onto the intermediate image transfer belt 7.

The static eliminators 12*a*, 12*b*, 12*c*, and 12*d* are disposed to face surfaces of the photoreceptor drums 2*a*, 2*b*, 2*c*, and 2*d*, respectively. The static eliminators 12*a*, 12*b*, 12*c*, and 12*d* each remove electricity (eliminate an electrical charge) from a surface of each of the photoreceptor drums 2*a*, 2*b*, 2*c*, and 2*d* after the primary image transfer, by irradiating light on the surface of each of the photoreceptor drums 2*a*, 2*b*, 2*c*, and 2*d*.

The drum cleaning parts 11*a*, 11*b*, 11*c*, and 11*d* are disposed to face the surfaces of the photoreceptor drums 2*a*, 2*b*, 2*c*, and 2*d*, respectively. The drum cleaning parts 11*a*, 11*b*, 11*c*, and 11*d* remove toner and attached matter remaining on the surfaces of the photoreceptor drums 2*a*, 2*b*, 2*c*, and 2*d*, respectively, and convey the removed toner to a collection mechanism such that the toner is collected.

The secondary image transfer roller 8 causes the full-color toner image, which has been primarily transferred to the intermediate image transfer belt 7, to be secondarily transferred to a sheet of paper T. A secondary bias is applied to the secondary image transfer roller 8 to transfer the full-color toner image formed on the intermediate image transfer belt 7 to the sheet of paper T by the primary transfer bias application part (not illustrated).

The secondary image transfer roller 8 comes into contact with and departs away from the intermediate image transfer belt 7 selectively. More specifically, the secondary image transfer roller 8 is configured to be movable between a contact position at which it is in contact with the intermediate image transfer belt 7 and a spaced position at which it is spaced apart from the intermediate image transfer belt 7. In particular, the secondary image transfer roller 8 is disposed at the contact position when it transfers the toner image that has been primarily transferred to the surface of the intermediate image transfer belt 7 onto the sheet of paper T. Under other circumstances it is disposed at the spaced position.

The opposing roller 18 is disposed opposite to the secondary image transfer roller 8 across the intermediate image transfer belt 7. A portion of the intermediate image transfer belt 7 is sandwiched between the secondary image transfer roller 8 and the opposite roller 18. The sheet of paper T is pressed against an outer surface (a surface to which the toner image is primarily transferred) of the intermediate image transfer belt 7. A secondary image transfer nip N2 is formed between the intermediate image transfer belt 7 and the secondary image transfer roller 8. At the secondary image transfer nip N2, the full-color toner image primarily transferred to the intermediate image transfer belt 7 is secondarily transferred to the sheet of paper T.

The fixing part 9 fuses and pressurizes respective color toners forming the toner image that has been secondarily transferred to the sheet of paper T, such that the color toners are fixed on the sheet of paper T. The fixing part 9 includes a heating rotator 9*a* that is heated by a heater, and a pressing rotator 9*b* that is in pressure contact with the heating rotator 9*a*. The heating rotator 9*a* and the pressing rotator 9*b* sandwich and apply pressure to the sheet of paper T to which the toner image is secondarily transferred, and also feed the sheet of paper T. The sheet of paper T is fed while sandwiched between the heating rotator 9*a* and the pressing rotator 9*b*, so that the toner transferred to the sheet of paper T is fused and pressurized to be fixed to the sheet of paper T.

Next, the paper feeding/discharging unit KH will be described.

As illustrated in FIG. 1, the paper feeding cassette 52 is a cassette that stores sheets of paper T, and in which two cassettes are aligned vertically in a lower part of the apparatus main unit M. The paper feeding cassette 52 is configured to be manually drawn in a horizontal direction from a housing of the apparatus main unit M. The paper feeding cassette 52 includes a paper tray 60 on which the sheets of paper T are placed. The paper feeding cassette 52 stores the sheets of paper T stacked on the paper Tray 60. A sheet of paper T placed on the paper tray 60 is fed to the paper feed path L by a cassette feeding part 51 disposed in an end part of the paper feeding cassette 52 on a side of feeding the sheet of paper (at a right end portion of FIG. 1). The cassette feeding part 51 includes a double feed prevention mechanism including: a forward feed roller 61 for picking up a sheet of paper T on the paper tray 60; and a pair of paper feeding rollers 63 for feeding the sheet of paper T one at a time to the paper feed path L.

The manual feeding unit 64 is provided on a right lateral face (the right side in FIG. 1) of the apparatus main unit M. The manual feeding unit 64 is provided in order to feed other sheets of paper T to the apparatus main unit M, which are different in size and type from the sheets of paper T stored in the paper feeding cassette 52. The manual feeding unit 64 includes a manual feeding tray 65, which becomes a portion of a right lateral face of the apparatus main unit M when the manual feeding unit 64 is closed, and a paper feeding roller 66. A lower end of the manual feeding tray 65 is rotatably attached in a vicinity of the paper feeding roller 66 (openable and closeable). A sheet or sheets of paper T are placed on the manual feeding tray 65 while it is open. The paper feeding roller 66 feeds a sheet of paper T placed on the manual feeding tray 65 while it is open to the manual feeding path La.

The first discharging part 50*a* and the second discharging part 50*b* are provided on an upper side in the apparatus main unit M. The first discharging part 50*a* and the second discharging part 50*b* discharge the sheet of paper T to an outer part of the apparatus main unit M (including a post-processing apparatus or a job separator tray 410).

The paper feed path L that feeds the sheet of paper T includes a first paper feed path L1 from the cassette feeding part 51 to the secondary image transfer nip N2, a second paper feed path L2 from the secondary image transfer nip N2 to the fixing part 9, a third paper feed path L3 from the fixing part 9 to a first branch part Q1, and a fourth paper feed path L4 from the first branch part Q1 to the first discharging part 50*a*. The paper feed path L includes the manual paper feed path La that causes the sheet of paper supplied from the manual feeding unit 64 to be merged with the first paper feed path L1, the reversing paper feed path Lc from the first branch part Q1 to a reversing part Qb, the return paper feed path Lb that returns the sheet of paper fed through the reversing paper feed path Lc through a second branch part Q2 to the first paper feed path L1, the sub paper feed path Ld that feeds the sheet of paper fed in the reversing paper feed path Lc through the second branch part Q2 to the second discharging part 50*b*, and the junction paper feed path Le causing the sheet of paper T fed through the reversing paper feed path Lc to be merged with the fourth paper feed path L4 via the reversing part Qb and a third junction P3.

The return paper feed path Lb causes a surface (an unprinted surface) opposite to a surface having already been printed to face the intermediate image transfer belt 7, when duplex printing of a sheet of paper T is performed. The return paper feed path Lb reverses and returns the sheet of paper T, one side of which has been printed, to the first paper feed path L1, and subsequently feeds the sheet of paper T to upstream of the pair of resist rollers 80, which is disposed upstream of the secondary image transfer roller 8. At the secondary image transfer nip N2, a toner image is transferred to the unprinted surface of the sheet of paper T that has been reversed by the return paper feed path Lb.

A first junction P1 and a second junction P2 are provided at positions along the first paper feed path L1. The third junction P3 is provided at a position along the fourth paper feed path L4. The first branch part Q1 is provided between the third paper feed path L3 and the fourth paper feed path L4. The second branch part Q2 is provided at a position along the reversing paper feed path Lc. The reversing part Qb is provided in proximity to a pair of reversing rollers 430 in the reversing paper feed path Lc.

The first junction P1 is where the manual paper feed path La merges into the first paper feed path L1. The second junction P2 is where the return paper feed path Lb merges into the first paper feed path L1. The third junction P3 is where the junction paper feed path Le merges into the fourth paper feed path L4.

The first branch part Q1 is where the third paper feed path L3 branches off into the fourth paper feed path L4 and the reversing paper feed path Lc. The second branch part Q2 is where the reversing paper feed path Lc branches off into the sub paper feed path Ld. The reversing part Qb is where reversing of the feeding direction of the sheet of paper T is executed.

The pair of resist rollers 80 is a rollers pair that aligns the timing with the formation of a toner image in the image forming unit GK or the correction of skew (inclined paper feed) of the sheet of paper T. The pair of resist rollers 80 and a sensor (not illustrated) for detecting the sheet of paper T are disposed at a position along the first paper feed path L1 (more specifically, between the second junction P2 and the secondary image transfer roller 8). The sensor is disposed immediately in front of the pair of resist rollers 80 in the direction of feeding the sheet of paper T (upstream in the feeding direction). The pair of resist rollers 80 performs the adjustment of timing and the correction described above based on the detection signal information from the sensor and feeds the sheet of paper T.

The pair of curl correction rollers 85 is a rollers pair that configures a part of the curl correction apparatus 500, and corrects (reduces) a curl in the sheet of paper T. The pair of curl correction rollers 85 corrects the curl in the sheet of paper T by inserting the sheet of paper T between the rollers pair. The pair of curl correction rollers 85 is disposed at a position along the fourth paper feed path L4 (more specifically, between the first branch part Q1 and the third junction P3).

The curl correction apparatus 500 will be described in detail later.

The first discharging part 50*a* is provided on an end of the fourth paper feed path L4. The first discharging part 50*a* is disposed in an upper portion of the apparatus main unit M. The first discharging part 50*a* has an opening toward a left lateral face of the apparatus main unit M (a left side opposite to the manual feeding part 64 in FIG. 1). The first discharging part 50*a* discharges the sheet of paper T fed through the fourth paper feed path L4 to outside the apparatus main unit M.

A post-processing apparatus (not illustrated) may be connected to the open side with respect to the first discharging part 50*a*. The post-processing apparatus executes post-processing of the sheet of paper T discharged from the first discharging part 50*a* (stapling, punching, and the like).

The second discharging part 50*b* is provided in the job separator 400. The second discharging part 50*b* is disposed at an upper portion of the apparatus main unit M. The second discharging part 50*b* opens toward the right side of the apparatus main unit M (the right side in FIG. 1, on a side the manual feeding unit 64 lies). The second discharging part 50*b* discharges the sheet of paper T sorted by the job separator 400 to an outer part of the apparatus main unit M (job separator tray 410).

It should be noted that a sensor for detecting a sheet of paper is disposed at a predetermined position of each paper feed path.

The job separator 400 performs a predetermined sorting process on the sheet of paper T, and is provided at a right upper portion of the apparatus main unit M (right side of FIG. 1). For example, the job separator 400 performs a sorting process to discharge the sheet of paper T from the second discharging part 50*b*. The job separator 400 performs processing to reverse the direction of feeding the sheet of paper T when the sheet of paper T is discharged from the second discharging part 50*b* and when duplex printing is performed. When a sheet inserter (not illustrated) is optionally mounted on the job separator 400, the job separator 400 performs a sorting process to cause the sheet of paper T inserted by the sheet inserter into the job separator 400 to be merged into the fourth paper feed path L4.

The job separator 400 includes a job separator tray 410, a second pair of discharging rollers 420, a pair of reversing rollers 430, a first branch member 440, a second branch member 450, and a third branch member 460.

The job separator tray 410 receives the sheet of paper T sorted by the job separator 400 and discharged from the second discharging part 50*b*.

The second pair of discharging rollers 420 is provided on the second discharging part 50*b*, and discharges the sheet of paper T reversed in the reversing part Qb through the second discharging part 50*b*.

The pair of reversing rollers 430 is provided in the reversing part Qb, and sandwiches the sheet of paper T positioned on the reversing part Qb, such that the feeding direction of the sheet of paper T is reversed. When the sheet inserter is mounted on the job separator 400, the pair of reversing rollers 430 has a function of feeding rollers that feed the sheet of paper T inserted into the job separator by the sheet inserter without changing the feeding direction.

The first branch member 440 is provided on the first branch part Q1. The first branch member 440 branches (switches) the direction of feeding the sheet of paper T fed through the third paper feed path L3 into the fourth paper feed path L4 or the reversing paper feed path Lc.

The second branch member 450 is provided on the reversing part Qb. The second branch member 450 branches (switches) the sheet of paper T that is fed through the reversing paper feed path Lc, in an upward direction of the second branch member 450, or towards the fourth paper feed path L4. A space above the second branch member 450 has the function of a reversing space for reversing the sheet of paper T sandwiched by the pair of reversing rollers 430.

The third branch member 460 is provided on the second branch part Q2. The third branch member 460 branches (switches) a direction of feeding the sheet of paper T fed through the reversing paper feed path Lc, towards the return paper feed path Lb or the sub paper feed path Ld. When the sheet inserter is mounted on the job separator 400, the third branch member 460 branches (switches) the sheet of paper T fed through the sub paper feed path Ld into the reversing paper feed path Lc.

Next, operation of the copy machine 1 according to the first embodiment will be briefly described.

Firstly, the image forming operation will be briefly described.

Image information read by the reader unit 301 is output to the apparatus main unit M. The image information input to the apparatus main unit M is delivered to an image forming control unit (not illustrated). The image forming control unit controls the photoreceptor drums 2*a* to 2*d*, the charging parts 10*a* to 10*d*, the laser scanner units 4*a* to 4*d*, the developing units 16*a* to 16*d*, or the like that compose the image forming unit GK, based on the image information. A predetermined toner image is formed on the photoreceptor drums 2*a*, 2*b*, 2*c* and 2*d* based on the image information.

The toner image formed on the photoreceptor drums 2*a*, 2*b*, 2*c* and 2*d* is primarily transferred sequentially to the intermediate image transfer belt 7 at the primary image transfer nips N1, N1*b*, N1*c* and N1*d*. The toner image that has been primarily transferred to the intermediate image transfer belt 7 is secondarily transferred onto the sheet of paper T fed through the paper feed path L at the secondary image transfer nip N2. In this manner, an image that is the same as the document G is formed (copied) on the sheet of paper T. The sheet of paper T on which the image has been formed is discharged to outside the apparatus main unit M through the first discharging part 50*a* and the second discharging part 50*b*.

Next, feeding operations for a sheet of paper T in paper feeding patterns will be described in conjunction with the image forming operation, respectively.

Firstly, a paper feeding operation will be described when one-side printing is performed on a sheet of paper T stored in the paper feeding cassette 52, and the sheet of paper T is fed to the first discharging part 50*a*.

The sheet of paper T stored in the paper feeding cassette 52 is sent to the first paper feed path L1 by the forward feeding roller 61 and the pair of paper feeding rollers 63. The sheet of paper T passes through the pair of resist rollers 80 to be introduced between the intermediate image transfer belt 7 and the secondary image transfer roller 8 (secondary image transfer nip N2). At the secondary image transfer nip N2, a toner image is (secondarily) transferred to the sheet of paper T.

Thereafter, the sheet of paper T is discharged from between the intermediate image transfer belt 7 and the secondary image transfer nip N2, and guided into a fixing nip between the heating rotator 9*a* and the pressing rotator 9*b* in the fixing part 9. Toner is then fused in the fixing nip and fixed onto the sheet of paper T.

Next, the sheet of paper T is fed through the third paper feed path L3 and the fourth paper feed path L4 to the first discharging part 50*a*.

In this manner, one-side printing is performed on the sheet of paper T stored in the paper feeding cassette 52, and the sheet of paper T after one-side printing is fed to the first discharging part 50*a*.

Next, a paper feed operation will be described when one-side printing is performed on a sheet of paper T mounted on the manual tray 65.

The sheet of paper T mounted on the manual tray 65 is fed to the manual paper feed path La by the paper feeding roller 66, and then fed to the pair of resist rollers 80 via the first junction P1 and the first paper feed path L1. Subsequent operations are the same as those for the sheet of paper T stored in the paper feeding cassette 52, and descriptions related to such operations will not be repeated.

Next, a paper feed operation for a case of executing duplex printing will be described.

Operations are the same as those for a case of one-side printing until the sheet of paper T undergone one-side printing is discharged from the fixing part 9. In contrast, when duplex printing is performed, a sheet of paper T that is printed on one side is discharged from the fixing part 9. Subsequently, the sheet of paper T is fed through the third paper feed path L3 and fed toward the reversing paper feed path Lc at the first branch part Q1. The sheet of paper T is sent through the third paper feed path L3 by the pair of reversing rollers 430 in the reversing part Qb in a reverse direction (the direction from the pair of reversing rollers 430 to the second branch part Q2).

The sheet of paper T fed through the third paper feed path L3 in the reverse direction is guided into the return paper feed path Lb through the second branch part Q2. The sheet of paper T merges with the first paper feed path L1 via the second junction P2. Here, the sheet of paper T is turned upside down from the position of one-side printing.

The sheet of paper T is guided between the intermediate image transfer belt 7 and the secondary image transfer roller 8 via the first paper feed path L1. Since an unprinted surface of the sheet of paper T faces the secondary image transfer roller 8 as a result of passing through the return paper feed path Lb, a toner image is transferred to the unprinted surface and duplex printing is performed.

Next, a feed operation will be described when a sheet of paper T is discharged from the second discharging part 50*b*.

Operations are the same as those for a case where a sheet of paper T is discharged from the first discharging part 50*a* until the sheet of paper T is discharged from the fixing part 9. In contrast, when the sheet of paper T is discharged from the second discharging part 50*b*, the sheet of paper T that is discharged from the fixing part 9 is sent through the third paper feed path L3. Subsequently, the sheet of paper T is sent toward the reversing paper feed path Lc at the first branch part Q1.

The sheet of paper T is sent through the third paper feed path L3 by the pair of reversing rollers 430 in a reverse direction (from the pair of reversing rollers 430 to the second branch part Q2) at the reversing part Qb. The sheet of paper T fed through the third paper feed path L3 in the reverse direction is guided into the sub paper feed path Ld through the second branch part Q2. The sheet of paper T is discharged from the second discharging part 50*b*.

Next, an operation will be described for a case where a sheet inserter (not illustrated) is mounted on the job separator 400. In this case, a sheet of paper T that is inserted to the job separator 400 by the sheet inserter is discharged from the first discharging part 50*a*.

The sheet of paper T inserted to the job separator 400 by the sheet inserter is fed through the sub paper feed path Ld, and fed onto the reversing paper feed path Lc via the second branch part Q2. The second branch member 450 branches (switches) a paper feed direction of the sheet of paper T onto the junction paper feed path Le, and the sheet of paper T merges with the fourth paper feed path L4 via the third junction P3. The sheet of paper T is discharged from the first discharging part 50*a*.

Next, the sheet curl correction apparatus 500 that is a characteristic part in the copying machine 1 according to the first embodiment will be described in detail making reference to FIG. 2 to FIG. 10. The curl correction apparatus 500 includes the pair of curl correction rollers 85 as described above, and executes curl correction of a sheet of paper T using the pair of curl correction rollers 85.

Figure 2:
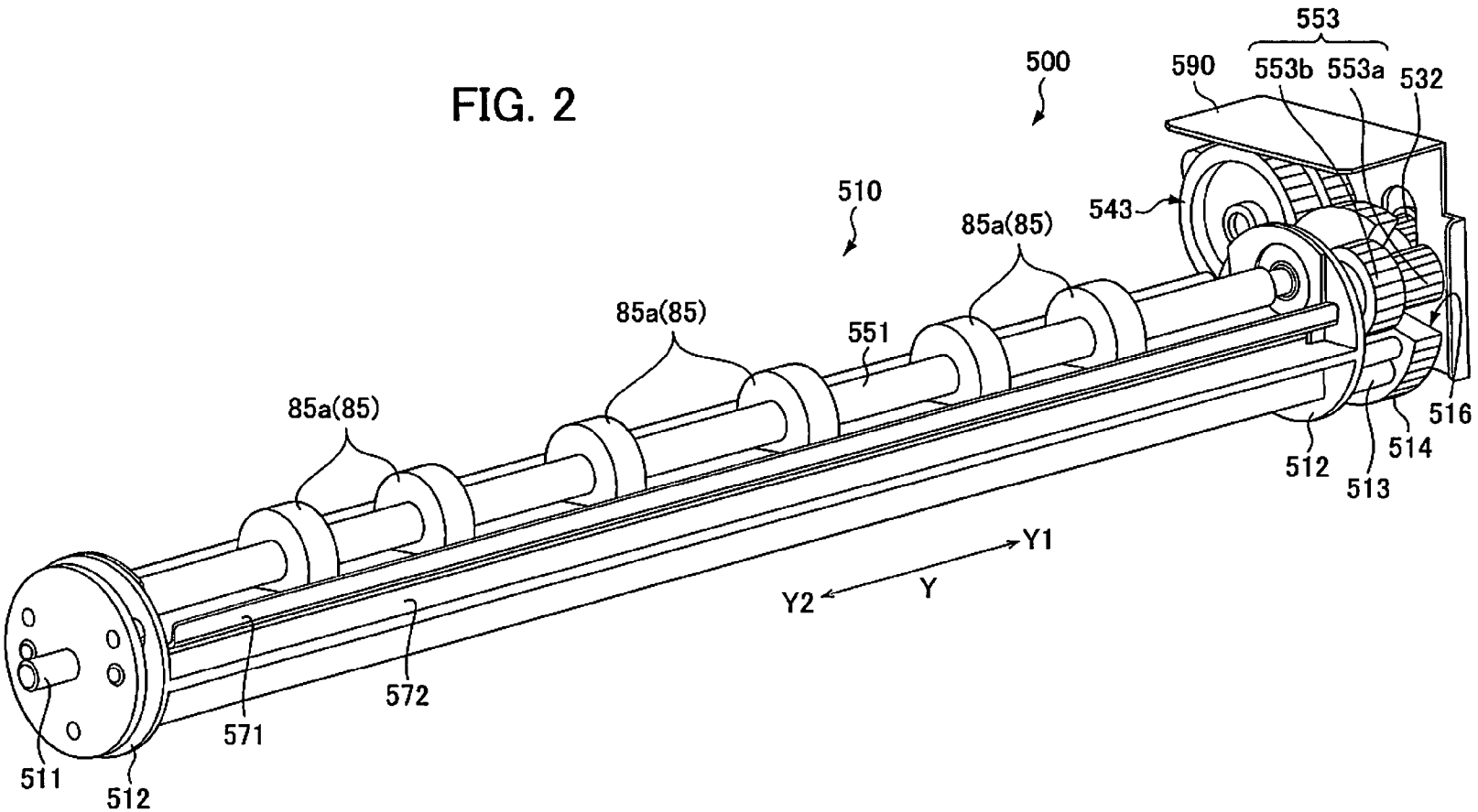
FIG. 2 is a perspective view illustrating the configuration of a curl correction unit 510 of a curl correction apparatus 500 for a sheet of paper in the copy machine 1 according to the first embodiment.
Figure 3:
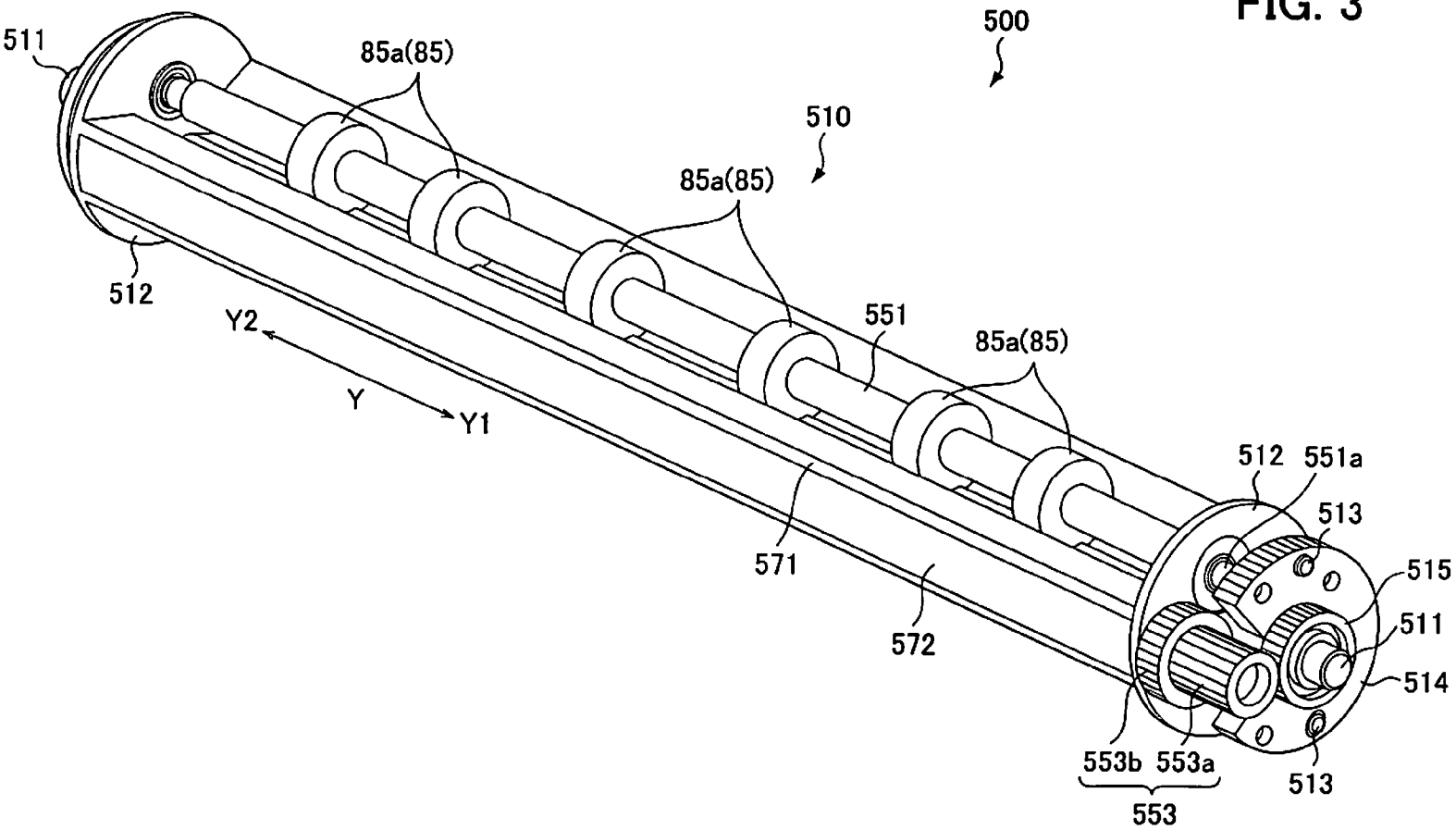
FIG. 3 is a perspective view illustrating the configuration of the curl correction unit 510 when reversed through 180 degrees with respect to FIG. 2.
Figure 4:
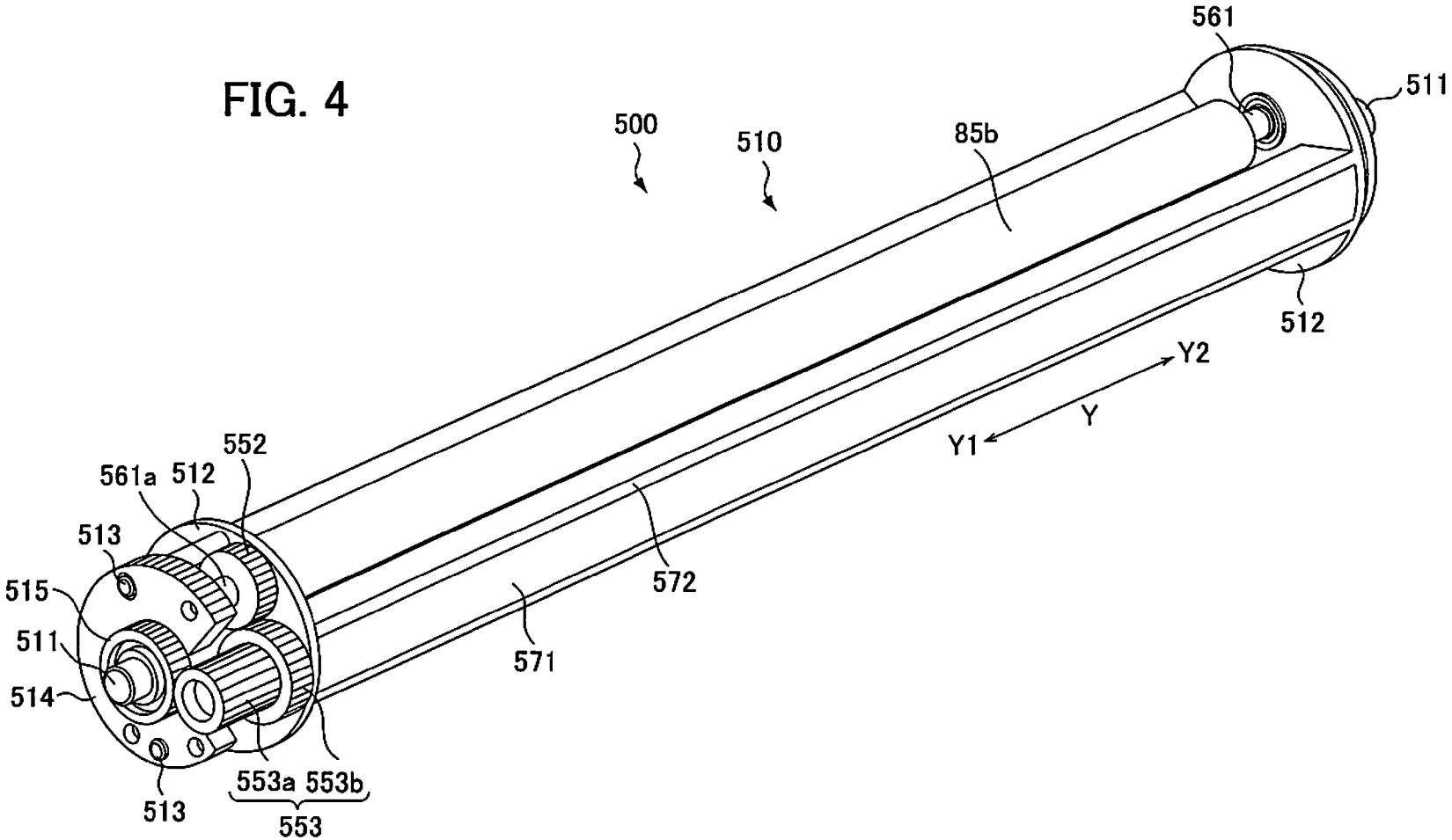
FIG. 4 is a perspective view illustrating the configuration of the curl correction unit 510 viewed from a hard roller 85*b;*
Figure 5:
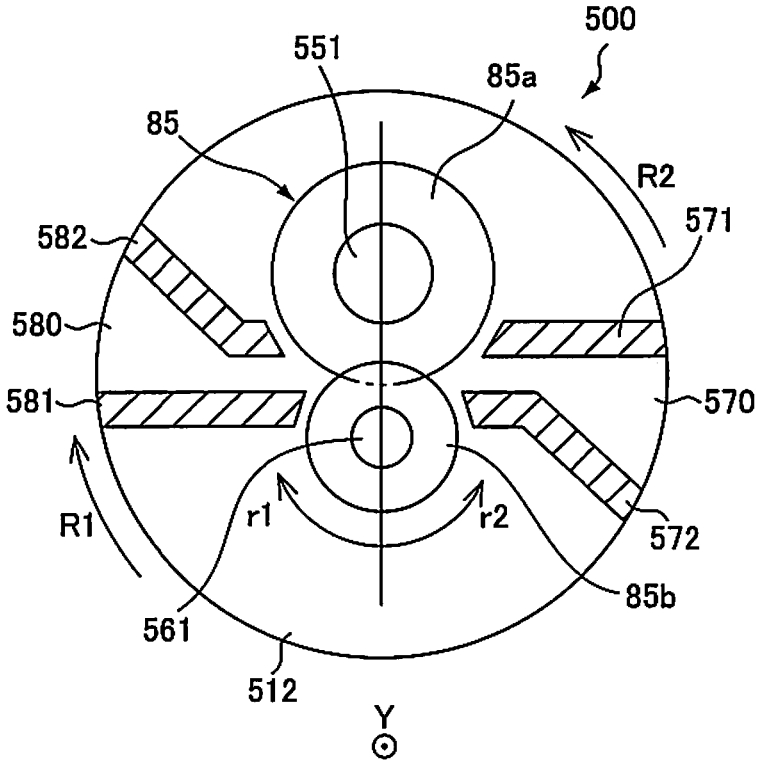
FIG. 5 is an enlarged sectional view of main constituent elements illustrating the configuration of the curl correction unit 510.
Figure 6:
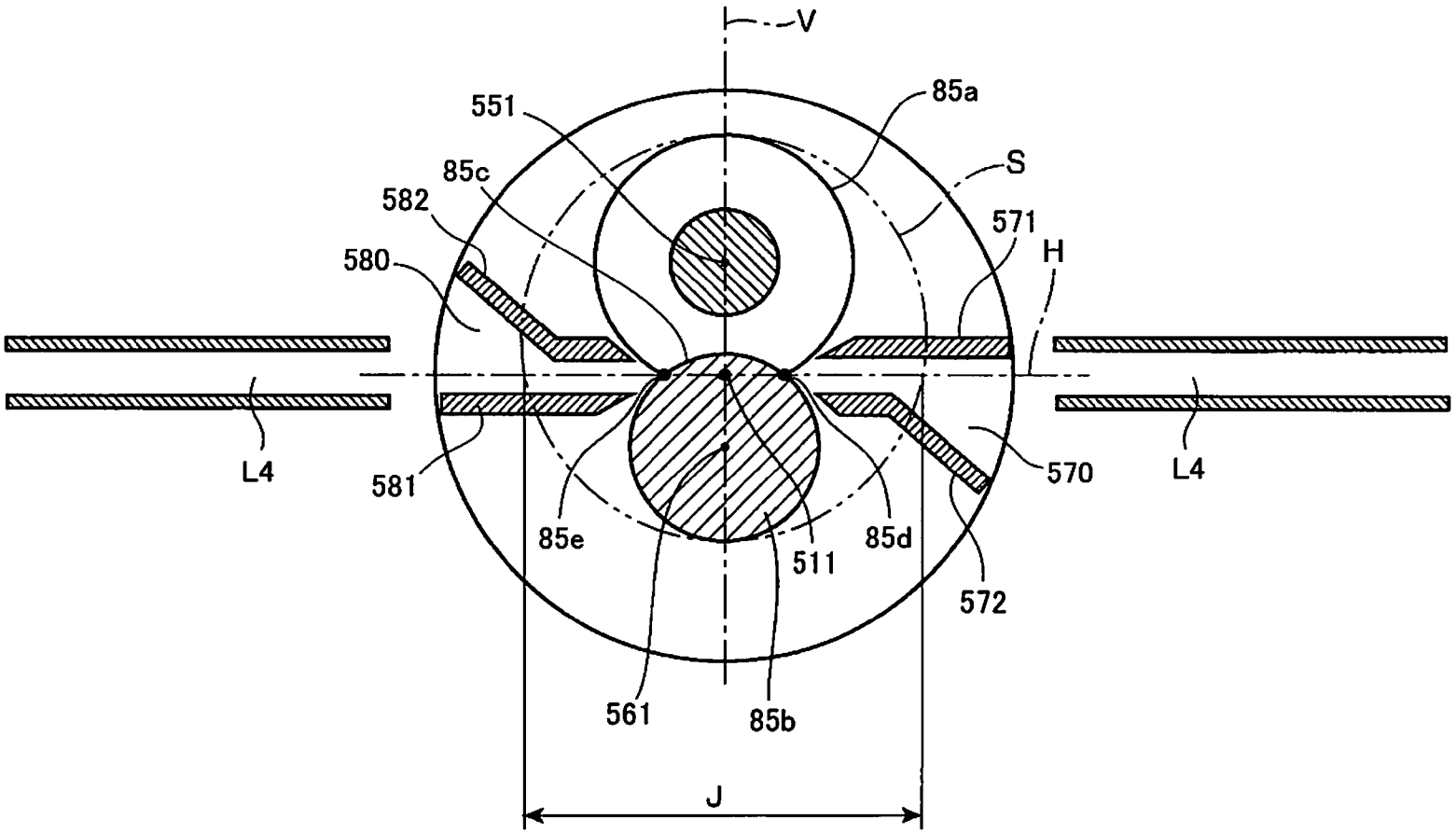
FIG. 6 is an enlarged sectional view illustrating a leading edge 85*d* and a trailing edge 85*e* of a nip 85*c* in the curl correction unit 510.
Figure 7:
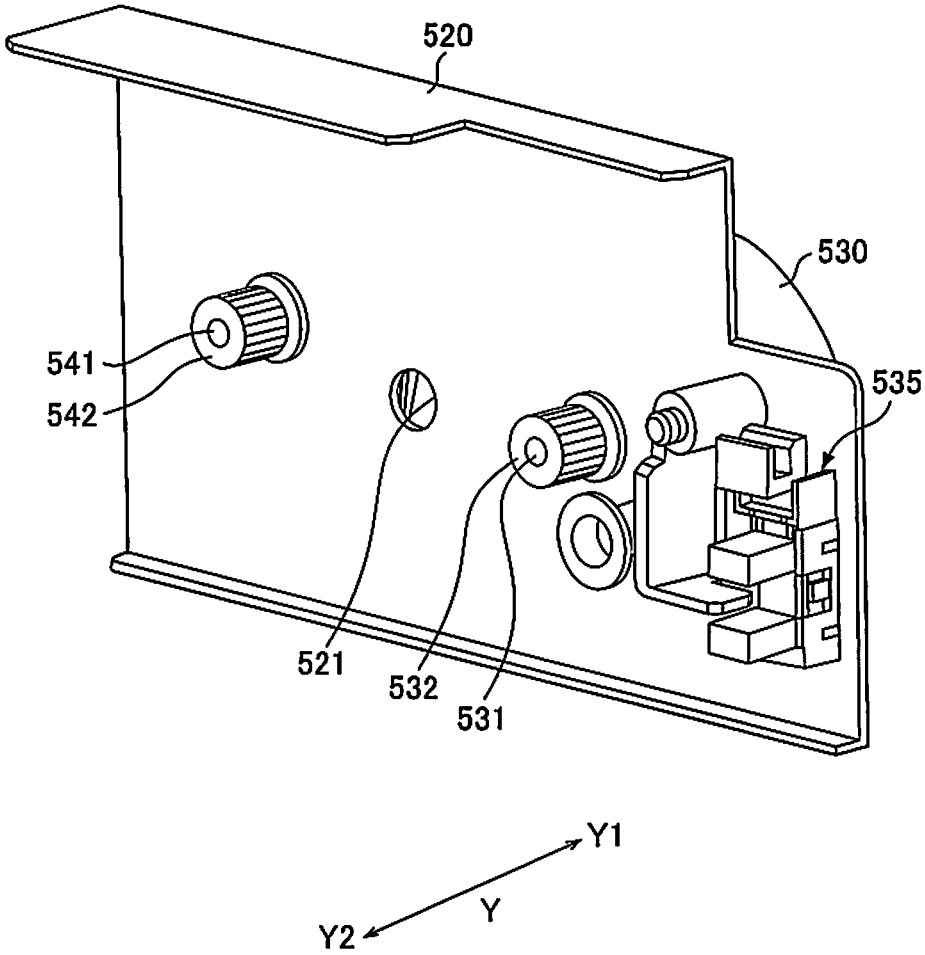
FIG. 7 is an enlarged perspective view of main constituent elements illustrating the configuration of the fixing member 520 of the curl correction apparatus 500 viewed from an apparatus main portion.

FIG. 2 is a perspective view illustrating the configuration of the curl correction unit 510 of the curl correction apparatus 500 for a sheet of paper in the copying machine 1 according to the first embodiment. FIG. 3 is a perspective view illustrating the configuration of the curl correction unit 510 when reversed through 180 degrees with respect to FIG. 2. FIG. 4 is a perspective view illustrating the configuration of the curl correction unit 510 viewed from the hard roller 85*b*. FIG. 5 is an enlarged sectional view of the main constituent elements illustrating the configuration of the curl correction unit 510. FIG. 6 is an enlarged sectional view illustrating the leading edge 85*d* and the trailing edge 85*e* of the nip 85*c* in the curl correction unit 510. FIG. 7 is an enlarged perspective view of the main constituent elements illustrating the configuration of the fixing member 520 viewed from the apparatus main portion side of the curl correction apparatus 500.

Figure 8:
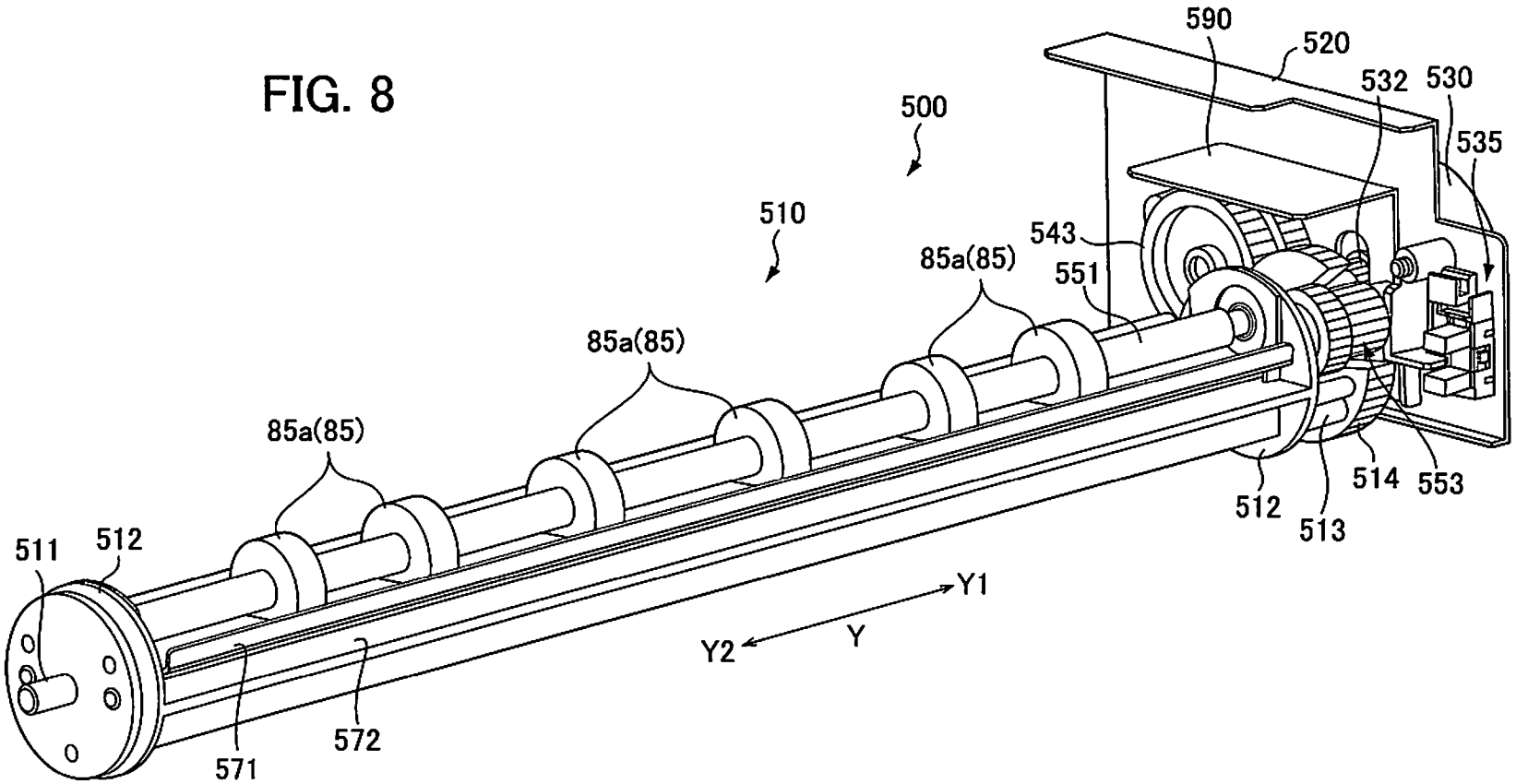
FIG. 8 is a perspective view illustrating the curl correction unit 510 assembled into the fixing member 520 viewed from the apparatus main portion.
Figure 9:
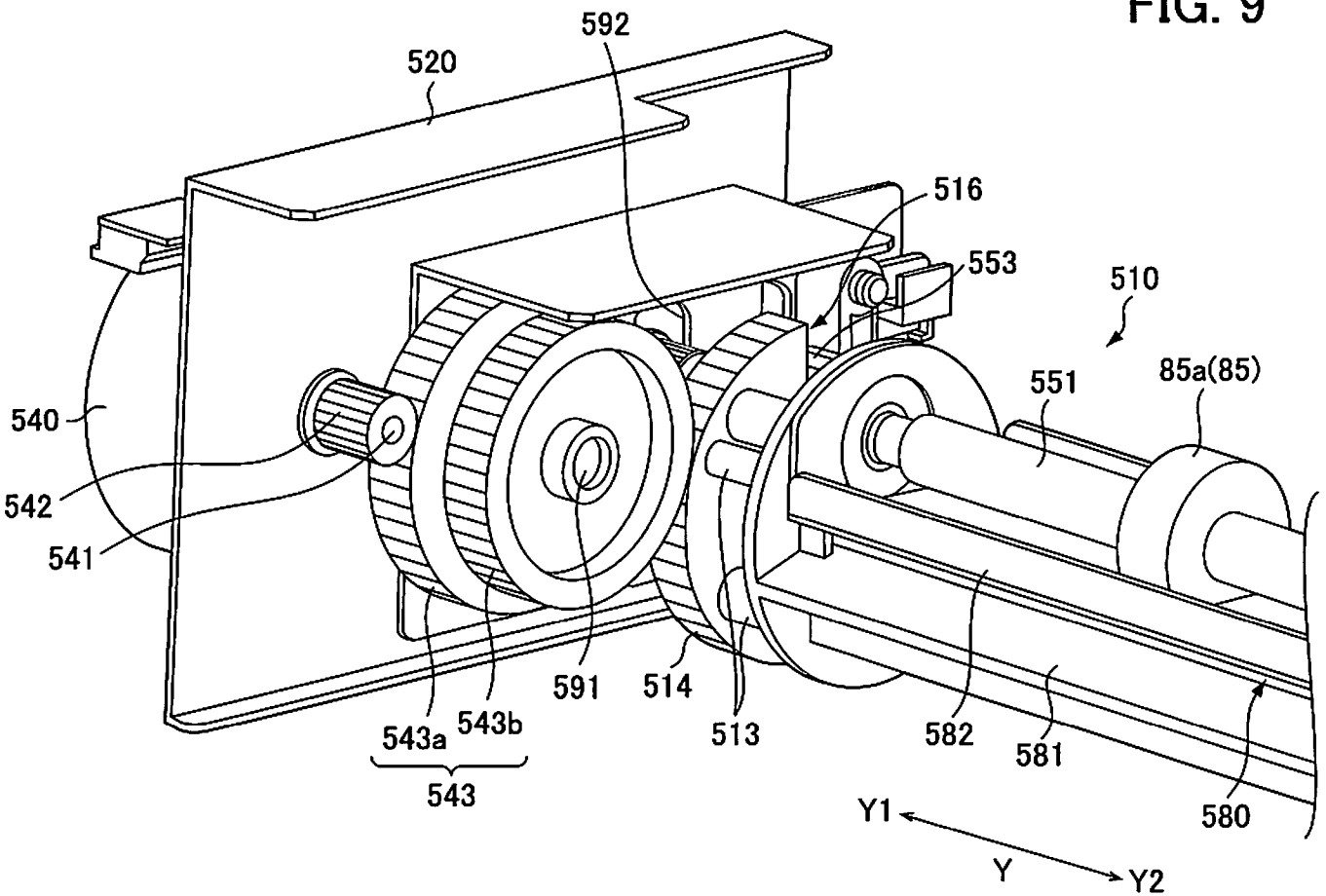
FIG. 9 is an enlarged perspective view illustrating the configuration of a unit drive motor 540 for driving the curl correction unit 510 to rotate.
Figure 10:
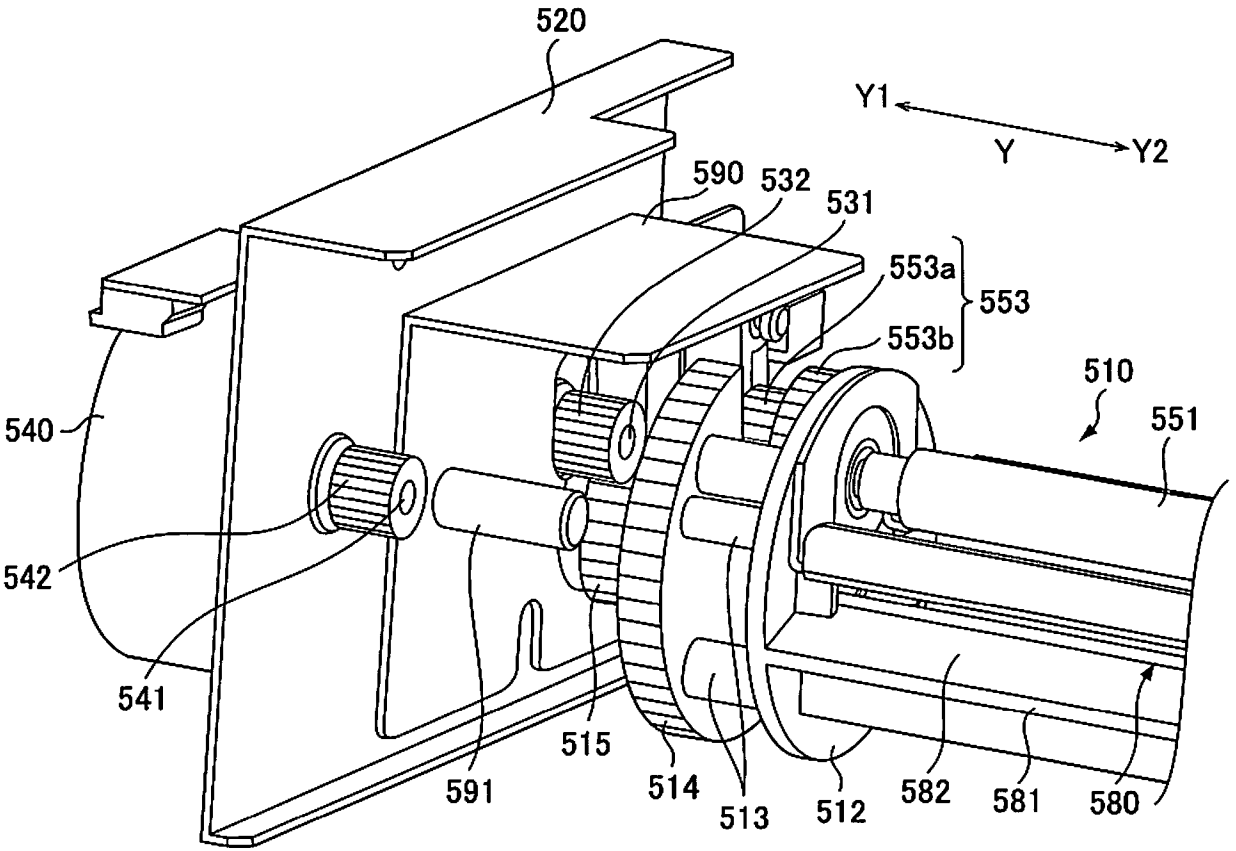
FIG. 10 is an enlarged perspective view of main constituent elements illustrating the configuration of a roller drive motor 530 of the curl correction apparatus 500.

FIG. 8 is a perspective view illustrating the curl correction unit 510 assembled into the fixing member 520 viewed from the apparatus main portion side. FIG. 9 is an enlarged perspective view illustrating the configuration of the unit drive motor 540 for driving the curl correction unit 510 to rotate. FIG. 10 is an enlarged perspective view illustrating the main constituent elements of the configuration of the roller drive motor 530 of the curl correction apparatus 500.

As illustrated in FIG. 2 to FIG. 10, the curl correction apparatus 500 according to the present embodiment includes a curl correction unit 510, a roller drive motor 530 acting as a second actuator, and a unit drive motor 540 acting as a first actuator.

As illustrated in FIG. 5, the curl correction unit 510 includes a pair of curl correction rollers 85 (85*a*, 85*b*), a third rotation shaft 511 (refer to FIG. 2 and FIG. 3), a pair of supporting members 512, a paper input guiding path 570 acting as a sheet guiding path, and a paper output guiding path 580 acting as a sheet discharge path. The pair of curl correction rollers 85 is formed from a soft roller 85*a* that acts as a first roller and a hard roller 85*b* that acts as a second roller.

As illustrated in FIG. 2 to FIG. 5, the third rotation shaft 511 extends in parallel with a first rotation shaft 551 of the first curl correcting roller 85*a* and a second rotation shaft 561 of the second curl correcting roller 85*b*. The second rotation shaft 561 is a shaft that is parallel to an axial direction of the first rotation shaft 551. The third rotation shafts 511 each project outwardly from a central part of an outer surface of each of the pair of supporting members 512 in an axial direction Y.

The pair of supporting members 512 rotatably supports the pair of curl correction rollers 85. Each supporting member 512 is formed as a circular plate. The pair of supporting members 512 is rotatable about the center of the third rotation shaft 511. The curl correction unit 510 switches the pair of supporting member 512 to rotate in positive and reverse directions through an angular range of approximately 180 degrees about the center of the third rotation shaft 511. Accordingly, the curl correction unit 510 is configured to vary the curl correction direction performed by the pair of curl correction rollers 85 (direction of correcting an upward curl and direction of correcting a downward curl).

The paper introduction path 570 guides a sheet of paper T such that the sheet of paper T goes between the pair of curl correction rollers 85 from upstream of the fourth paper feed path L4. The paper discharge path 580 guides the sheet of paper T that has passed through the pair of curl correction rollers 85 such that the sheet of paper T moves downstream in the fourth paper feed path L4.

As illustrated in FIG. 2, FIG. 3 and FIG. 8, the soft roller 85*a* is formed from a soft material such as synthetic resin or the like, and for example is made of a resilient member. The resilient member is formed from a material resiliently deformable, such as rubber or sponge. A plurality of soft rollers 85*a* is disposed with substantially constant intervals in the axial direction Y of the first rotation shaft 551 (width direction in the sheet of paper T), and each is fixed to the first rotation shaft 551. In other words, each soft roller 85*a* rotates about the first rotation shaft 551. The term "width direction in the sheet of paper T (sheet)" as used herein means a direction that is orthogonal to a sheet feed direction.

An interval between resilient members forming soft rollers 85*a* is determined according to the transverse dimension of a sheet subjected to a curl correction process, and may be constant or variable, for example. A resilient member that forms a soft roller 85*a* may be a cylindrical resilient member continuously encircling the first rotation shaft 551.

The plurality of soft rollers 85*a* as illustrated in FIG. 5 and FIG. 6 is brought into pressure contact with the outer peripheral surface of the hard roller 85*b* so that an outer peripheral part of each soft roller 85*a* becomes indented towards the first rotation shaft 551. In other words, the hard roller 85*b* is pressed to bite into each soft roller 85*a* such that a curved nip 85*c* is formed to allow the sheet of paper T to pass through between the hard roller 85*b* and the soft roller 85*a*. The "nip" as used herein means an interface between the pair of rollers that are brought into pressure contact with each other.

Accordingly, the peripheral surface of each soft roller 85*a* that comes in contact with the hard roller 85*b* is a deformed surface that undergoes resilient deformation in an inward direction (the direction towards the first rotation shaft 551), so that a curved nip 85*c* is formed. The curl in the sheet of paper T is corrected as it passes through the nip 85*c*.

The second rotation shaft 561 of the hard roller 85*b* is connected with the roller drive motor 530. As a result, the hard roller 85*b* is driven to rotate by the roller drive motor 530.

A direction of disposing the roller drive motor 530 and the unit drive motor 540 with reference to the axial direction Y is denoted as "Y1 direction" (Y1 side). A direction opposite to the Y1 direction is denoted as a "Y2 direction" (Y2 side).

The hard roller 85*b* is formed from a hard material such as metal or the like. The hard roller 85*b* is a cylindrical roller formed from a harder material than the resilient material used to form each soft roller 85*a*. As illustrated in FIG. 4, the hard roller 85*b* is an elongated roller having an outer peripheral surface with the same outer diameter across substantially the whole length of the axial direction Y (width direction of the sheet of paper T) of the second rotation shaft 561. The hard roller 85*b* extends between the two supporting members 512 in substantially parallel to soft rollers 85*a*. The hard roller 85*b* rotates about the second rotation shaft 561. A diameter of each soft roller 85*a* is larger than a diameter of the hard roller 85*b*. Each soft roller 85*a* is driven to rotate dependently in a reverse direction with respect to the hard roller 85*b* due to rotational driving of each soft roller 85*a* in pressure contact with the outer peripheral surface of the hard roller 85*b*.

The supporting members 512 are disposed at both ends of the first rotation shaft 551 and the second rotation shaft 561 as one pair opposite to each other in the axial direction Y. The pair of curl correction rollers 85 (85*a*, 85*b*) is rotatably supported across the pair of supporting members 512. A vertical pair of elongated plate members 571 and 572 that form the paper introduction path 570, and a vertical pair of elongated plate members 581 and 582 that form the paper discharge path 580 are fixed to span inner surfaces opposite to each other of the pair of supporting members 512. When the pair of supporting members 512 rotates, positions of the paper introduction path 570 and the paper discharge path 580 are exchanged for each other (refer to FIG. 11 and FIG. 12).

The elongated plate members 571, 572, 581 and 582 extend straight in a substantially horizontal direction. As illustrated in FIG. 5 and FIG. 6, an elongated plate member 572 bends in a direction of lying away from an elongated plate member 571 from an inner part to an outer part of the supporting member 512. An elongated plate member 582 bends in a direction of lying away from an elongated plate member 581 from an inner part to an outer part of the supporting member 512.

An elongated plate member 571 and the elongated plate member 572 form the paper introduction path 570 that narrows towards a contact portion (nip 85*c*) between each soft roller 85*a* and the hard roller 85*b*. An elongated plate member 581 and the elongated plate member 582 form the paper discharge path 580 that expands from the nip 85*c*.

As described below, an edge receiving a sheet of paper T moving towards the nip 85*c* of edges of the nip 85*c* of the curl correction apparatus 500 is denoted as a "leading edge 85*d*", and an edge from which for the sheet of paper T that has passed through the nip 85*c* is discharged is denoted as a "trailing edge 85*e*". A "first position" indicates a position at which the curl correction apparatus 500 receives the sheet of paper T moving towards the nip 85*c* from the leading edge 85*d* of the nip 85*c*. A "second position" indicates a position at which the curl correction apparatus 500 receives the sheet of paper T moving towards the nip 85*c* from the trailing edge 85*e* of the nip 85*c*.

However, these terms are for the purpose of merely facilitating the comprehension of the description, and in no manner limit the present invention. Therefore, for a case where the curl correction apparatus 500 is at the second position, it may be that an edge receiving the sheet of paper T moving towards the nip 85*c* of the edges of the nip 85*c* is denoted as a "leading edge 85*d*", and an edge from which paper T that has passed through the nip 85*c* is discharged is denoted as a "trailing edge 85*e*".

In the following description, when the curl correction apparatus 500 is at the first position, the leading edge 85*d* is the edge that receives the sheet of paper T moving towards the nip 85*c*, and the trailing edge 85*e* is the edge from which the sheet of paper T that has passed through the nip 85*c* is discharged.

Figure 12:
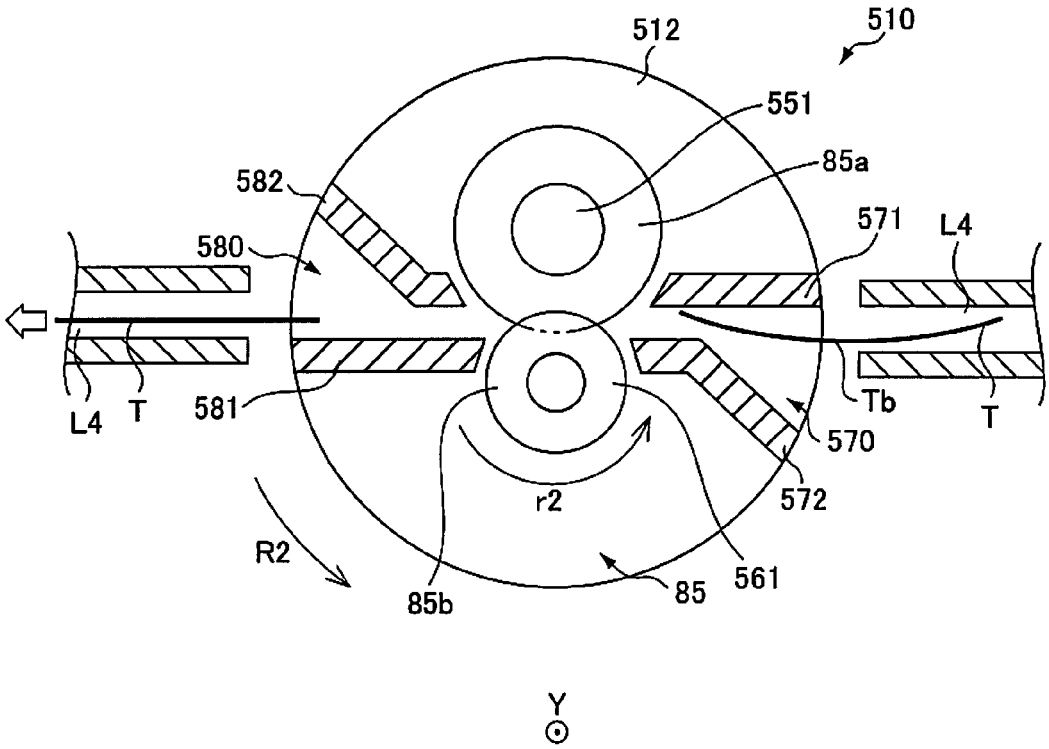
FIG. 12 is an enlarged sectional view of main constituent elements illustrating the configuration in which the curl correction unit 510 is rotated by the pair of curl correcting rollers 85 so that the direction of curl correction pair of curl correction rollers 85 is oriented in a second direction.

As illustrated in FIG. 5, FIG. 6 and FIG. 12, the curl correction apparatus 500 at the first position is capable of correcting a curl in a sheet of paper T having an upward curl. The sheet of paper T having an upward curl passes through the nip 85*c* formed between the soft roller 85*a* and the hard roller 85*b* along an upwardly curved deformation surface. As a result, an amount of downward curvature of the sheet of paper T is decreased.

Figure 11:
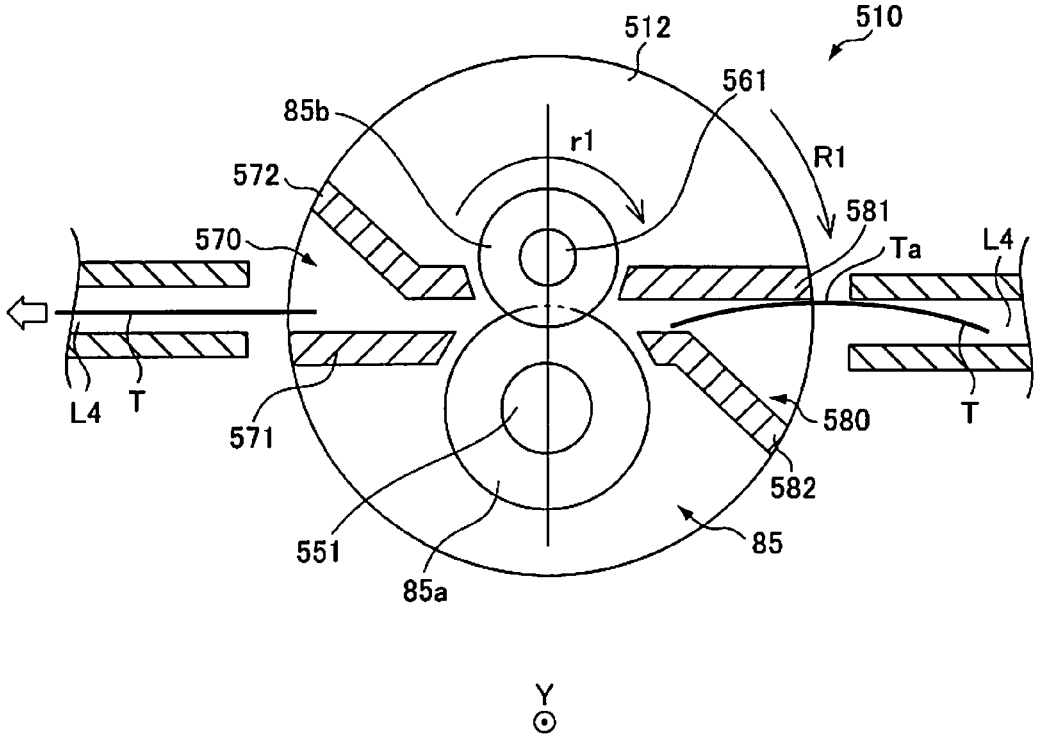
FIG. 11 is an enlarged sectional view of main constituent elements illustrating a state in which the curl correction unit 510 is rotated by a pair of curl correcting rollers 85 so that the direction of curl correction pair of curl correction rollers 85 is oriented in a first direction.

Conversely as illustrated in FIG. 11, when the curl correction apparatus 500 is at the second position, the deformation surface (nip 85*c*) is curved downwardly since the hard roller 85*b* is positioned above the soft roller 85*a*. Accordingly, the curl correction apparatus 500 at the second position corrects a curl in the sheet of paper T having a downward curl.

The third rotation shaft 511 extends coinciding with a line of intersection between a first plane (horizontal plane) H passing through the leading edge 85*d* and the trailing edge 85*e* and a second plane (vertical plane) V passing through the first rotation shaft 551 and the second rotation shaft 561. In other words, the third rotation shaft 511 extends in parallel with the axial direction of the first rotation shaft 551 within the plane of the first plane H including the leading edge 85*d* and the trailing edge 85*e* of the nip 85*c*. The third rotation shaft 511 is formed along the line of intersection between the second plane V including the first rotation shaft 551 and the second rotation shaft 561 and the first plane H.

As illustrated in FIG. 6, FIG. 11 and FIG. 12, when the third rotation shaft 511 is formed along the line of intersection of the first plane H and the second plane V, a first positional relationship between the paper introduction path 570 of the curl correction apparatus 500 at the first position and the fourth paper feed path L4 that is formed upstream of the curl correction apparatus 500 is substantially equal to a second positional relationship between the fourth paper feed path L4 and the paper discharge path 580 of the curl correction apparatus 500 at the second position. The first positional relationship is related to a distance between the paper introduction path 570 and the fourth paper feed path L4 in the feed direction of the sheet of paper T, and a distance between the paper introduction path 570 and the fourth paper feed path L4 in a direction orthogonal to the plane of the sheet of paper T being fed. The second positional relationship is related to a distance between the paper discharge path 580 and the fourth paper feed path L4 in the feed direction, and a distance between the paper discharge path 580 and the fourth paper feed path L4 in a direction orthogonal to the plane of the sheet of paper T being fed.

Similarly, a third positional relationship between the fourth paper feed path L4 that is formed downstream of the curl correction apparatus 500 and the paper discharge path 580 of the curl correction apparatus 500 at the first position is substantially equal to a fourth positional relationship between the fourth paper feed path L4 and the paper introduction path 570 of the curl correction apparatus 500 at the first position. The third positional relationship is related to a distance between the paper discharge path 580 and the fourth paper feed path L4 in the feed direction, and a distance between the paper discharge path 580 and the fourth paper feed path L4 in a direction orthogonal to the plane of the sheet of paper T being fed. The fourth positional relationship is related to a distance between the paper introduction path 570 and the fourth paper feed path L4 in the feed direction, and a distance between the paper introduction path 570 and the fourth paper feed path L4 in a direction orthogonal to the plane of the sheet of paper T being fed.

In this manner, the feed condition for the sheet of paper T upstream of the curl correction apparatus 500 when the sheet of paper T is received from the leading edge 85*d* side towards the nip 85*c* (first position) is substantially the same as the feed condition for the sheet of paper T upstream of the curl correction apparatus 500 when the sheet of paper T moving toward the nip 85*c* is received from the trailing edge 85*e* (second position). Similarly, the feed condition for the sheet of paper T upstream of the curl correction apparatus 500 when the sheet of paper T that has undergone curl correction is discharged from the leading edge 85*d* (second position) is substantially the same as the feed condition for the sheet of paper T downstream of the curl correction apparatus 500 when the sheet of paper T that has undergone curl correction is discharged from the trailing edge 85*e* (first position).

Thus, even when the direction of curl correction for the sheet of paper T is varied, the feed conditions for the sheet of paper T are maintained constant. When the third rotation shaft 511 extends in a direction along the first rotation shaft 551 and the second rotation shaft 561 within the first plane H (horizontal direction), a distance in a direction orthogonal with the surface of the fed sheet of paper T between the paper introduction path 570 and/or the paper discharge path 580 and the fourth paper feed path L4 is maintained substantially constant. Therefore, the third rotation shaft 511 may be formed at an arbitrary position within the first plane H.

A displacement of the third rotation shaft 511 from the line of intersection between the first plane H and the second plane V appears as an amount of displacement of the curl correction apparatus 500 in the feed direction of the sheet of paper T. Therefore, as illustrated in FIG. 6, it may be preferable that the third rotation shaft 511 is disposed between a pair of intersection points formed by a circumscribed circle S of the soft roller 85 and the hard roller 85*b* with the first plane H (a distance between the intersection points in FIG. 6 denoted as "J").

The pair of fixing members 520 including a bearing hole 521 (only one illustrated in FIG. 8) is provided in the apparatus main unit M. The pair of supporting members 512 is rotatably supported between the pair of fixing members 520 about the center of the third rotation shaft 511, both ends of which are inserted into bearing holes 521 of the pair of fixing members 520.

The fixing members 520 are respectively disposed near both ends (Y1 side, Y2 side) in the Y direction of the pair of curl correction rollers 85 in the curl correction unit 510, and are fixed to the apparatus main unit M. The roller drive motor 530 and the unit drive motor 540 are fixed to an outer surface of one fixing member 520 disposed on one end (Y1 side) of the Y direction.

In this connection, the other fixing member (not illustrated) has the same shape and size as the one fixing member 520. The other fixing member includes only a bearing hole for rotatably supporting the other end (Y2 side) of the third rotation shaft 511 on the supporting member 512.

As illustrated in FIG. 7, a pinion gear 532 and a pinion gear 542 are disposed in the fixing member 520 to project inwardly (Y2 direction). The pinion gear 532 is fixed to the output shaft 531 of the roller drive motor 530. The pinion gear 542 is fixed to the output shaft 541 of the unit drive motor 540. A rotation control component 535 and the like of both drive motors 530 and 540 are mounted on an inner surface of the fixing member 520.

As illustrated in FIG. 2, FIG. 3, FIG. 8, and FIG. 10, an outer gear 514 is fixed and supported through a plurality of supporting members 513 on an outer side (one end side, Y1 side) in the shaft direction Y of the supporting member 512. The outer gear 514 is unrotatably connected to the supporting member 512. The outer gear 514 is a partial tooth gear that has teeth formed across a range of substantially 270 degrees and a cutout 516 in a residual range of substantially 90 degrees with respect to a rotation angle. The outer gear 514 rotatably supports an intermediate gear 515 as an input gear, and includes a peripheral surface on which gear teeth are formed. The third rotation shaft 511 of the supporting member 512 determines the center of the fan-shaped outer gear 514.

As illustrated in FIG. 3, the intermediate gear 515 is fixed to the third rotation shaft 511 of the curl correction unit 510. The intermediate gear 515 is a gear that engages with the pinion gear 532 fixed to the output shaft 531 of the roller drive motor 530. In other words, the intermediate gear 515 receives a rotational force transmitted from the roller drive motor 530.

One end of the second rotation shaft 561 of the hard roller 85*b* in the curl correction unit 510 extends outwardly from the supporting member 512. A first gear 552 adapted to rotate the hard roller is fixed to an extended rotation shaft part 561*a*. The first gear 552 is connected to an end of the hard roller 85*b* on a side closer to the unit drive motor 540.

A double diameter gear 553 includes a third gear 553*a* acting as a small-diameter gear engaging with the intermediate gear 515 and a second gear 553*b* acting as a large-diameter gear engaging with the first gear 552. The third gear 553*a* and the second gear 553*b* rotate coaxially with each other. The double diameter gear 553 is retained rotatably on the supporting member 512. The third gear 553*a* of the double diameter gear 553 is disposed in the cutout 516 of the outer gear 514. In this manner, the roller drive motor 530 drives the hard roller 85*b* of the pair of curl correction rollers 85 to rotate through the pinion gear 532, the intermediate gear 515, the double diameter gear 553, and the first gear 552.

As illustrated in FIG. 9 and FIG. 10, a gear retaining frame 590 is fixed to an inner surface (Y2 side) of the fixing member 520. A fixing shaft 591 is fixed to and a through hole 592 is provided in the gear retaining frame 590, from which the fixing shaft 591 projects. The through hole 592 is a hole to enable the output shaft 531 and the pinion gear 532 to project toward the curl correction unit 510.

The double diameter gear 543 is retained on the fixing shaft 591 of the gear retaining frame 590 rotatably about the center of the fixing shaft 591. The double diameter gear 543 includes a large-diameter gear 543*a* and a small-diameter gear 543*b* engaging with the outer gear 514. The large-diameter gear 543*a* is a gear engaging with the pinion gear 542 fixed to the output shaft 541 of the unit drive motor 540. In this manner, the unit drive motor 540 is connected to the outer gear 514 through the pinion gear 542, the double diameter gear 543 and the outer gear 514. Accordingly, the unit drive motor 540 drives the supporting member 512 of the curl correction unit 510 to rotate about the third rotation shaft 511 in positive and reverse directions through an angular range of 180 degrees.

The unit drive motor 540 rotates the supporting member 512 between the first position at which the sheet of paper T moving towards the nip 85*c* is received from the leading edge 85*b* and the second position at which the sheet of paper T moving towards the nip 85*c* is received from the trailing edge 85*e*.

Next, the operation of the curl correction apparatus 500 will be described making reference to FIG. 11 and FIG. 12.

FIG. 11 is an enlarged sectional view of the main constituent elements illustrating the state in which the curl correction unit 510 is rotated so that the direction of curl correction by the pair of curl correction rollers 85 is oriented in a first direction. FIG. 12 is an enlarged sectional view of the main constituent elements illustrating the state in which the curl correction unit 510 is rotated so that the direction of curl correction by the pair of curl correction rollers 85 is oriented in a second direction.

When a sheet of paper T having a downward curl due to fixing by the fixing part 9 is fed through the fourth paper feed path L4, the unit drive motor 540 is driven in a clockwise direction. The rotation drive force is transmitted to the supporting member 512 of the curl correction unit 510 through the pinion gear 542, the double diameter gear 543 and the outer gear 514. In this manner, the supporting member 512 of the curl correction unit 510 is driven to rotate about the third rotation shaft 511 in a direction of an arrow R1. As a result, a direction of curl correction performed by the pair of curl correction rollers 85 is set (changed) to a direction corresponding to a downward curl.

In other words, as illustrated in FIG. 11, the soft roller 85*a* of the pair of curl correction rollers 85 is positioned lower than the fourth paper feed path L4. On the other hand, the hard roller 85*b* is positioned higher than the fourth paper feed path L4. The paper introduction path 570 is disposed downstream of the fourth paper feed path L4. The paper discharge path 580 is disposed upstream of the fourth paper feed path L4. In this configuration, the rotation of the curl correction unit 510 is stopped.

Simultaneously with or immediately after driving of the unit drive motor 540, the roller drive motor 530 is also driven. The rotation drive force is transmitted to the hard roller 85*b* of the pair of curl correction rollers 85 through the pinion gear 532, the intermediate gear 515, the double diameter gear 553 and the first gear 552. In this manner, the hard roller 85*b* is driven to rotate in a direction of an arrow r1, and the soft roller 85*a* is dependently driven.

A sheet of paper T that is fed through the fourth paper feed path L4 under this configuration, is guided between the pair of curl correction rollers 85 via the paper discharge path 580, and passes between the pair of curl correction rollers 85. During passing through the pair of curl correction rollers 85, an upper protruding part Ta of the sheet of paper T is pressed deeply towards the soft roller 85*a* by the hard roller 85*b*, so that the downward curl in the sheet of paper T is corrected. The sheet of paper T after correction of the downward curl is fed through the paper introduction path 570 towards downstream of the fourth paper feed path L4.

Next, when a sheet of paper T having an upward curl due to the fixing performed by the fixing part 9 is fed through the fourth paper feed path L4, the unit drive motor 540 is driven in a counter-clockwise direction. That rotation drive force is transmitted to the supporting member 512 of the curl correction unit 510 through the pinion gear 542, the double diameter gear 543 and the outer gear 514. In this manner, the supporting member 512 of the curl correction unit 510 is driven to rotate about the third rotation shaft 511 in a direction of an arrow R2. As a result, a direction of curl correction performed by the pair of curl correction rollers 85 is set (changed) to a direction corresponding to upward curl.

In other words, as illustrated in FIG. 12, the soft roller 85*a* of the pair of curl correction rollers 85 is positioned at higher than the fourth paper feed path L4. On the other hand, the hard roller 85*b* is positioned lower than the fourth paper feed path L4. The paper discharge path 580 that switches its position as a result of the rotation of the curl correction unit 510 is disposed downstream of the fourth paper feed path L4. The paper introduction path 570 is disposed upstream of the fourth paper feed path L4. In this configuration, the rotation of the curl correction unit 510 is stopped.

The roller drive motor 540 is also driven simultaneously with or immediately after the direction of curl correction being changed to correspond to an upward curl by driving of the unit drive motor 540. The rotation drive force is transmitted to the hard roller 85*b* of the pair of curl correction rollers 85 through the pinion gear 532, the intermediate gear 515, the double diameter gear 553 and the first gear 552. In this manner, the hard roller 85*b* is driven to rotate in a direction of an arrow r2, and the soft roller 85*a* is dependently driven.

In this configuration, the sheet of paper T that is fed through the fourth paper feed path L4 is guided between the pair of curl correction rollers 85 via the paper introduction path 570 that is switched to have a function of paper introduction path, and passes between the pair of curl correction rollers 85. During passing through the pair of curl correction rollers 85, a downwardly protruding part Tb of the sheet of paper T is pressed deeply towards the soft roller 85*a* by the hard roller 85*b*, so that the upward curl in the sheet of paper T is corrected. The sheet of paper T after correction of the upward curl is fed through the paper discharge path 580 that is switched to have a function of paper discharge path towards downstream of the fourth paper feed path L4.

The sheet curl correction apparatus 500 in the copying machine 1 according to the first embodiment described above obtains the following effects.

The curl correction apparatus 500 according to the first embodiment includes the soft roller 85*a* that rotates about the first rotation shaft 551 and is formed in a resiliently deformable configuration, the hard roller 85*b* that rotates about the second rotation shaft 561 that is parallel to the axial direction of the first rotation shaft 551 and is formed in a harder material than the first roller, the supporting member 512 that supports the soft roller 85*a* and the hard roller 85*b*, the unit drive motor 540 that rotates the supporting member 512 about the third rotation shaft 511, the first gear 552 that is connected to the end of the hard roller 85*b* near the first actuator 540, the second gear 553*b* that engages with the first gear 552, the third gear 553*a* that rotates coaxially with the second gear 553*b*, the intermediate gear 515 that engages with the third gear 553*a*, and the roller drive motor 530 that transmits the rotational force to the intermediate gear 515.

The hard roller 85*b* is brought into pressure contact with to bite into the soft roller 85*a* such that the curved nip 85*c* for allowing a sheet of paper T to pass through is formed between the hard roller 85*b* and the soft roller 85*a*. The third rotation shaft 511 extends in parallel with the axial direction of the first rotation shaft 551 within the plane of the first plane H including the leading edge 85*d* and the trailing edge 85*e* of the nip 85*c*. The unit drive motor 540 rotates the supporting member 512 between a first position at which the sheet of paper T moving towards the nip 85*c* is received from the leading edge 85*d* of the nip 85*c* and a second position at which the sheet of paper T moving towards the nip 85*c* is received from the trailing edge 85*e* of the nip 85*c*.

Consequently, according to the first embodiment, the soft roller 85*a* and the hard roller 85*b* rotate together, and do not interfere with the movement of a sheet of paper T passing through the nip 85*c*. The curved nip 85*c* corrects a curl in the sheet of paper T passing through the nip 85*c*. The soft roller 85*a* and the hard roller 85*b* are supported by the supporting members 512. The unit drive motor 540 causes the supporting members 512 to rotate about the third rotation shaft 511 between the first position and the second position.

At the first position, the sheet of paper T moving towards the nip 85*c* is received from the leading edge 85*d* of the nip 85*c*. At the second position, the sheet of paper T moving towards the nip 85*c* is received from the trailing edge 85*e* of the nip 85*c*. The third rotation shaft 511 of the supporting member 512 extends along the axial direction of the first rotation shaft 551 and the second rotation shaft 561 within the first plane H that contains the leading edge 85*d* and the trailing edge 85*e* of the nip 85*c*.

Consequently, the amounts of displacement of the leading edge 85*d* and the trailing edge 85*e* in a direction that traverses the surface of the sheet of paper T are reduced for cases where the supporting members 512 are placed at the first position and the second position. Accordingly, the two rollers (the soft roller 85*a* and the hard roller 85*b*) correct the curl in the sheet of paper T, so that the curl correction apparatus 500 can be downsized.

The curl correction apparatus 500 according to the first embodiment is driven by the first gear 552 that is connected to the end near the unit drive motor 540 on the hard roller 85*b*, the second gear 553*b* that engages with the first gear 552, the third gear 553*a* that rotates coaxially with the second gear 553*b*, the intermediate gear 515 that engages with the third gear 553, and the roller drive motor 530 that transmits a rotational force to the intermediate gear 515.

Accordingly, since the unit drive motor 540 and the roller drive motor 530 are positioned on the same end side of the curl correction apparatus 500, the overall length of the curl correction apparatus 500 is reduced, and the curl correction apparatus 500 can be further downsized. Furthermore, the curl correction apparatus 500 is provided as a practical apparatus since the electrical power supply path to the unit drive motor 540 and the roller drive motor 530 is simplified.

The first embodiment further includes the outer gear 514 that rotatably supports the intermediate gear 515 and has a peripheral surface that has gear teeth formed. The outer gear 514 is unrotatably connected to the supporting member 512, and the unit drive motor 540 is connected to the outer gear 514.

Consequently, the unit drive motor 540 transmits the drive force to the outer gear 514 in the first embodiment. The outer gear 514 is unrotatably connected to the supporting member 512. Therefore, the outer gear 514 rotates together with the supporting members 512, so that the direction of curl correction is suitably varied. Furthermore, a safer curl correction apparatus 500 is provided since the outer gear 514 covers the first gear 552, the second gear 553*b*, the third gear 553*a* and the intermediate gear 515.

In the first embodiment, the third rotation shaft 511 is formed along the line of intersection between the first plane H and the second plane V including the first rotation shaft 551 and the second rotation shaft 561. Consequently, the first embodiment reduces an amount of eccentricity of the rotation of the supporting member 512, so that the curl correction apparatus 500 can be further downsized.

The sheet curl correction apparatus 500 according to the first embodiment includes: the pair of curl correction rollers 85; the supporting members 512 that rotatably support the pair of curl correction rollers 85 and are rotatable about the third rotation shaft 511 parallel to the first rotation shaft 551 and the second rotation shaft 561; the curl correction unit 510 changing the direction of curl correction performed by the pair of curl correction rollers 85; the roller drive motor 530 driving the pair of curl correction rollers 85 to rotate and the unit drive motor 540 driving the supporting member 512 of the curl correction unit 510 to rotate. The roller drive motor 530 and the unit drive motor 540 are provided on the fixing member 520 that rotatably supports the curl correction unit 510 and is secured to the apparatus main unit M.

Consequently, the weight of the roller drive motor 530 is supported by the fixing member 520 secured to the apparatus main unit M. In this manner, there is no need for the curl correction unit 510 to support the weight of the roller drive motor 530 and the space occupied by the roller drive motor 530. Therefore, it is possible to implement the weight reduction and downsizing of the curl correction unit 510. Furthermore, it is possible to reduce the rotational load of the unit drive motor 540 and the power consumption required for changing the direction of curl correction by driving the curl correction unit 510 to rotate.

Moreover, a portion of wires for supplying power to the roller drive motor 530, or the control part does not occupy an inner portion of the curl correction unit 510. As a result, it is easy to draw the curl correction unit 510 from inside to outside the apparatus main unit M for troubleshooting a jam or the like, so that maintenance performance is upgraded.

Furthermore, in the curl correction apparatus 500 according to the first embodiment, the roller drive motor 530 and the unit drive motor 540 are disposed on one end in the axial direction Y of the pair of curl correction rollers 85 (Y1 side) in the curl correction unit 510.

Consequently, when the curl correction unit 510 is drawn from inside to outside the apparatus main unit M, it is possible to draw the curl correction unit 510 in a direction in which the drive motors 530 and 540 are not disposed. In this manner, since no interference is caused by either of the drive motor 530 or 540 when the curl correction unit 510 is removed, it is possible to perform maintenance much more easily and efficiently.

Furthermore, the supporting member 512 in the curl correction unit 510 of the curl correction apparatus 500 according to the first embodiment includes the outer gear 514. The curl correction unit 510 includes the intermediate gear 515 that is fixed to the third rotation shaft 511. The unit drive motor 540 drives the supporting member 512 to rotate via the outer gear 514. The roller drive motor 530 drives the pair of curl correction rollers 85 to rotate via the intermediate gear 515.

Consequently, when the curl correction unit 510 is inserted to the fixing member 520 disposed near the apparatus main unit M from one end in the axial direction Y of the first rotation shaft 551 and the second rotation shaft 561 of the pair of curl correction rollers 85 toward the fixing member 520, the gears of both drive motors 530 and 540 provided near to the fixing member 520 can simultaneously engage with the outer gear 514 and the intermediate gear 515 of the curl correction unit 510. In this manner, it is possible to reduce trouble associated with assembling the curl correction apparatus 500 into the apparatus main unit M. In addition, it is possible to perform removal and insertion operations of the curl correction unit 510 simply and efficiently during maintenance such as jam troubleshooting.

Second Embodiment

Next, a second embodiment of the present invention will be described with reference to FIG. 13 and FIG. 14.

Figure 13:
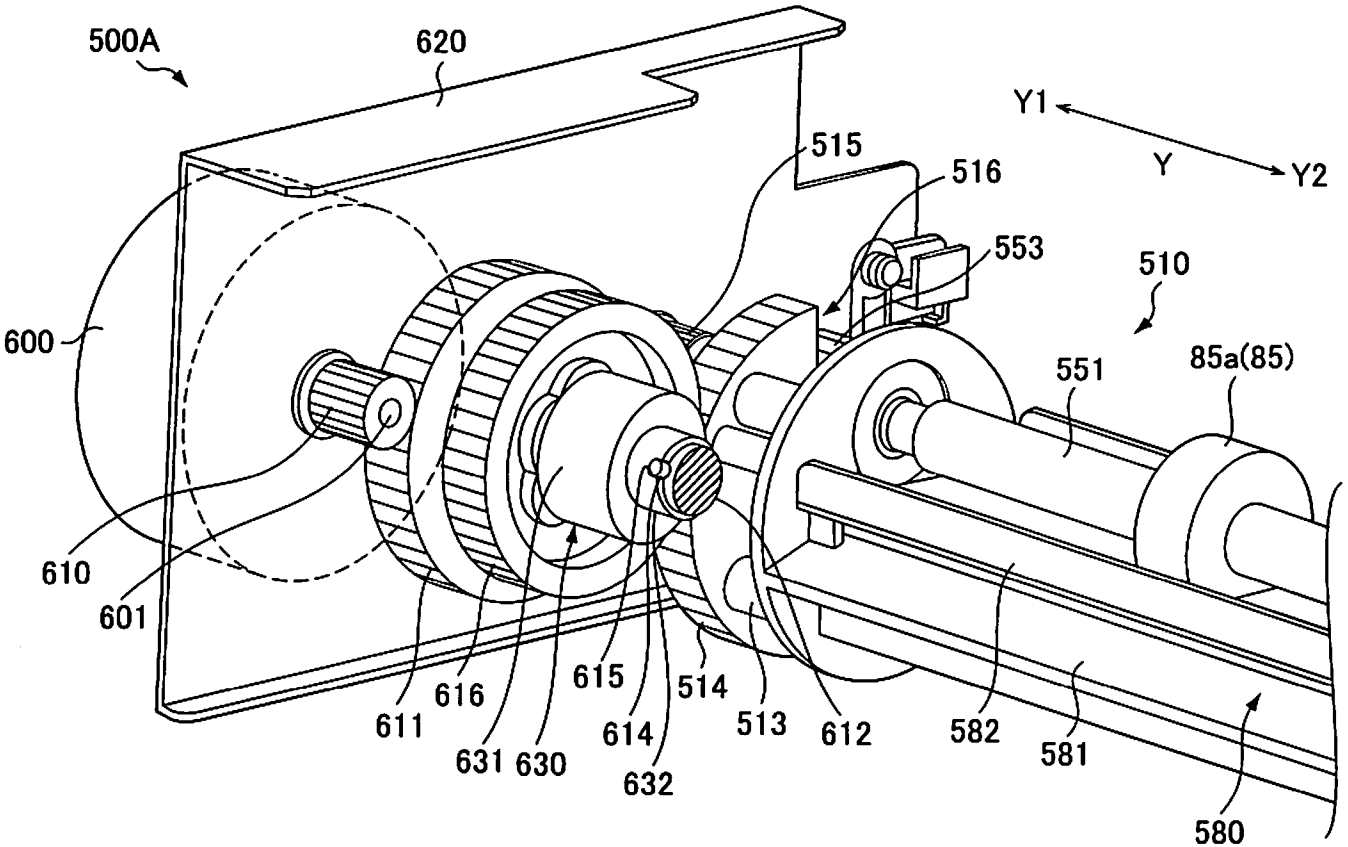
FIG. 13 is an enlarged perspective view of main constituent elements illustrating the configuration of a single drive motor 600 that drives a curl correction unit 510 of a sheet curl correction apparatus 500A to rotate and the periphery thereof in a copying machine 1 according to a second embodiment of the present invention.

FIG. 13 is an enlarged perspective view of the main constituent elements illustrating the configuration of a single drive motor 600 and the periphery thereof that drives to rotate a curl correction unit 510 of a curl correction apparatus 500A for a sheet of paper in a copying machine 1 according to a second embodiment of the present invention. FIG. 14 is an enlarged plan view of the main constituent elements illustrating the configuration of the single drive motor 600 and the periphery thereof that drives to rotate the curl correction unit 510 of the sheet curl correction apparatus 500A in the copying machine 1 according to the second embodiment.

In comparison to the curl correction apparatus 500 according to the first embodiment, the curl correction apparatus 500A according to the second embodiment mainly differs in that a pair of curl correction rollers 85 and the curl correction unit 510 are rotationally driven by switching a rotation direction of the single drive motor 600. The description of the second embodiment will focus mainly on differences from the first embodiment, and those elements same as the first embodiment are denoted with the same reference numerals, and detailed description thereof will be omitted. The description of the first embodiment is applicable to what are not described in particular about the second embodiment.

Figure 14:
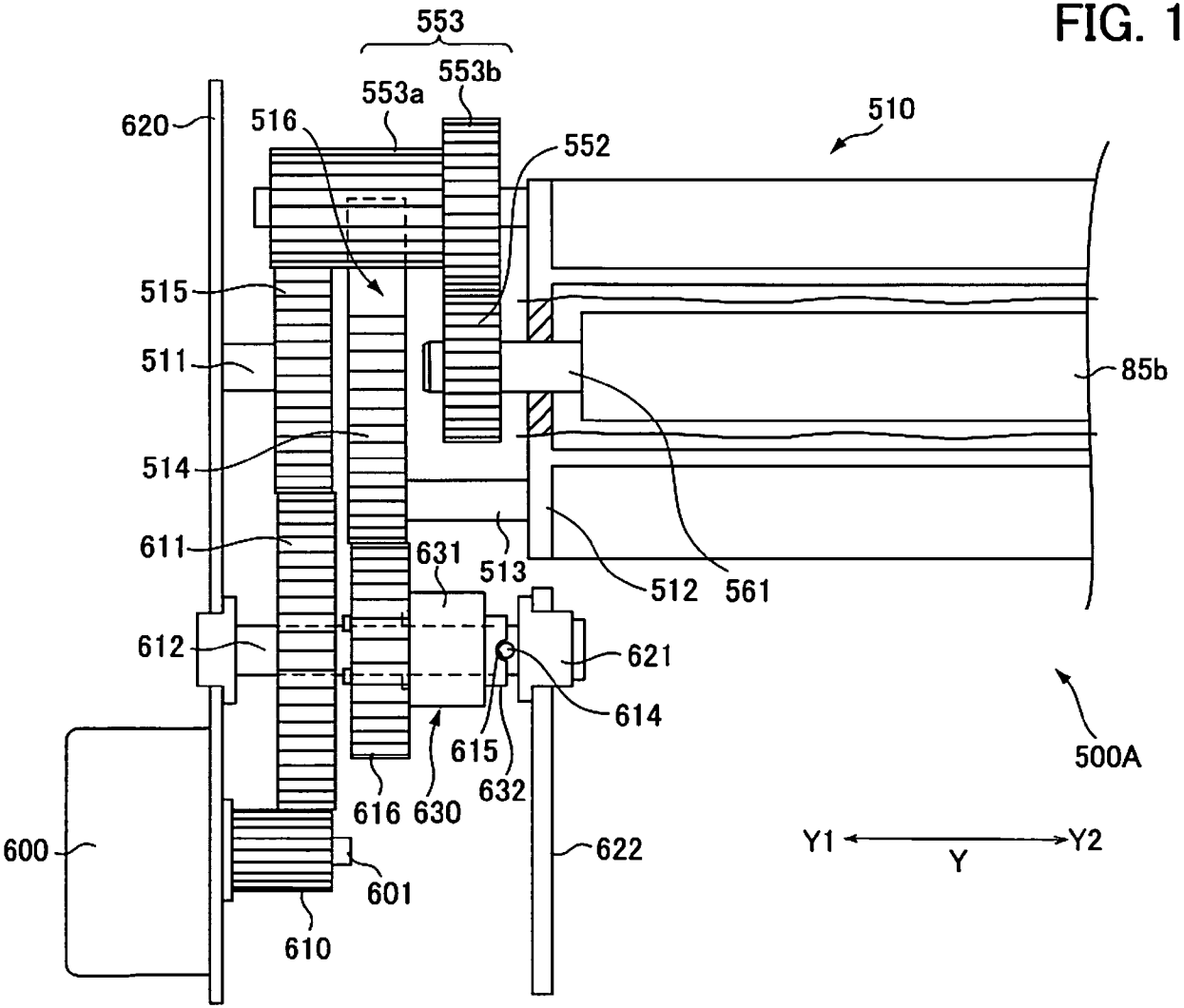
FIG. 14 is an enlarged plan view of main constituent elements illustrating the configuration of the single drive motor 600 that drives the curl correction unit 510 of the sheet curl correction apparatus 500A to rotate and the periphery thereof in the copying machine 1 according to the second embodiment.

As illustrated in FIG. 13 and FIG. 14, the curl correction apparatus 500A according to the present embodiment includes the single drive motor 600 that is secured to an outer surface of a fixed member 620 near to an apparatus main unit M. The single drive motor 600 drives (concurrently) the pair of curl correction rollers 85 and the curl correction unit 510 to rotate.

An output shaft 601 of the drive motor 600 projects into the fixing member 620 (Y2 direction). A pinion gear 610 is fixed to the projecting output shaft 601. A gear 611 engaging with the pinion gear 610 is supported rotatably by the fixing member 620 through the support shaft 612. An intermediate gear 515 engages with the gear 611. The intermediate gear 515 is a gear that is supported rotatably on a third rotation shaft 511 of a supporting member 512 in the curl correction unit 510. The intermediate gear 515 engages with a third gear 553*a* of a double diameter gear 553. The double diameter gear 553 also includes a second gear 553*b* that engages with a first gear 552 for rotating a hard roller.

The support shaft 612 of the gear 611 projects from the fixing member 620 towards the curl correction unit 510 (Y2 side). A projecting end of the support shaft 612 is rotatably supported through a bearing 621 on a fixing plate member 622 positioned more inward than the fixing member 620. A rotation direction switching gear 616 and a torque limiter 630 are coaxially and rotatably and coaxially mated with the support shaft 612.

The torque limiter 630 includes a tubular housing 631 and an inner ring 632 that sandwich a sliding member (not illustrated) composed of a hard ring and a magnet and that are rotatable with respect to each other. The inner ring 632 is disposed inside the tubular housing 631. The housing 631 engages with and rotates integrally with the rotation direction switching gear 616. The inner ring 632 and the support shaft 612 are connected to be integrally rotatable through a pin engagement indentation 615 formed in the inner ring 632 and a pin 614 projecting from the support shaft 612.

The rotation direction switching gear 616 engages with an outer gear (partial tooth gear) 514. The outer gear 514 is fixed and supported through a plurality of supporting members 513 on the supporting member 512 of the curl correction unit 510.

Next, switching operation for the curl correction direction will be described performed by the curl correction apparatus 500A configured as described above according to the second embodiment.

When a sheet of paper T having a downward curl due to fixing by a fixing part 9 is fed through a fourth paper feed path L4, a rotation drive force generated by the single drive motor 600 driven to rotate in a positive direction is transmitted to the gear 611 through the pinion gear 610. In this manner, the support shaft 612 rotates. When the support shaft 612 rotates, the rotation is transmitted to the inner ring 632 of the torque limiter 630 through the pin 614 and the pin engagement indentation 615. The rotation of the inner ring 632 is transmitted to the housing 631 through the sliding member (not illustrated) of the torque limiter 630.

In this manner, the rotation direction switching gear 616 rotates in a positive direction. As a result, the rotation of the rotation direction switching gear 616 is transmitted to the outer gear 514. In this manner, the supporting member 512 of the curl correction unit 510 is driven to rotate about the third rotation shaft 511 in a direction of an arrow R1 (refer to FIG. 11). As a result, a direction of curl correction performed by the pair of curl correction rollers 85 is varied to a direction corresponding to a downward curl.

At the same time, the rotation of the gear 611 is transmitted to a hard roller 85*b* of the pair of curl correction rollers 85 through the double diameter gear 553 and the first gear 522. In this manner, the hard roller 85*b* is driven to rotate in a direction of an arrow r1 (refer to FIG. 11), and a soft roller 85*a* dependently rotates.

When the supporting member 512 of the curl correction unit 510 is operated (rotated) (state shown in FIG. 11) so that the direction of curl correction performed by the pair of curl correction rollers 85 is changed to a position corresponding to a downward curl, a predetermined load is applied to the housing 631 of the torque limiter 630 and the rotation direction switching gear 616. When the predetermined load is applied, slippage occurs between the housing 631 and the inner ring 632 of the torque limiter 630, and the rotation of the support shaft 612 is no longer transmitted to the housing 631. Consequently, the rotation of the rotation direction switching gear 616 stops. Even under this condition, the rotation of the gear 611 is continuously transmitted to the hard roller 85*b* of the pair of curl correction rollers 85 through the double diameter gear 553 and the first gear 552. In this manner, the hard roller 85*b* is continuously driven in the direction of the arrow r1 and the soft roller 85*a* continues to rotate dependently, so that correction of the downward curl is normally performed.

When a sheet of paper T having an upward curl due to fixing by the fixing part 9 is fed through the fourth paper feed path L4, the rotation drive force generated by the single drive motor 600 driven to rotate in a reverse direction is transmitted through the pinion gear 610 to the gear 611. In this manner, the support shaft 612 is rotated. When the support shaft 612 rotates, the rotation is transmitted to the inner ring 632 of the torque limiter 630 through the pin 614 and the pin engagement indentation 615. The rotation of the inner ring 632 is transmitted to the housing 631 through the sliding member (not illustrated) of the torque limiter 630.

In this manner, the rotation direction switching gear 616 rotates in a reverse direction. As a result, the rotation of the rotation direction switching gear 616 is transmitted to the outer gear 514. In this manner, the supporting member 512 of the curl correction unit 510 is driven to rotate about the third rotation shaft 511 in a direction of an arrow R2 (refer to FIG. 12). As a result, the direction of curl correction performed by the pair of curl correction rollers 85 is varied to a direction corresponding to an upward curl.

At the same time, the rotation of the gear 611 is transmitted to the hard roller 85*b* of the pair of curl correction rollers 85 through the double diameter gear 553 and the first gear 522. In this manner, the hard roller 85*b* is driven to rotate in a direction of an arrow r2 (refer to FIG. 12), so that the soft roller 85*a* rotates dependently.

When the supporting member 512 of the curl correction unit 510 is operated (state as shown in FIG. 12) so that the direction of curl correction performed by the pair of curl correction rollers 85 is changed to a position corresponding to an upward curl, a predetermined load is applied to the housing of the torque limiter 630 and the rotation direction switching gear 616. When the predetermined load is applied, slippage occurs between the housing 631 and the inner ring 632 of the torque limiter 630, and the rotation of the support shaft 612 is no longer transmitted to the housing 631.

Consequently, the rotation of the curl correction unit rotation direction switching gear 616 is stopped. Even under this condition, the rotation of the gear 611 is continuously transmitted to the hard roller 85*b* of the pair of curl correction rollers 85 through the double diameter gear 553 and the first gear 552. In this manner, the hard roller 85*b* is continuously driven to rotate in the direction of the arrow r2 and the soft roller 85*a* continues to rotate dependently, so that correction of the upward curl is performed normally.

The curl correction apparatus 500A according to the second embodiment obtains the following effects in addition to those according to the first embodiment.

In the curl correction apparatus 500A according to the second embodiment, the rotation of the curl correction unit 510 by the first actuator and the rotation of the pair of curl correction rollers 85 by the roller drive motor 530 is executed by switching the direction of rotation of the single drive motor 600 between positive and reverse directions.

In other words, only if the rotational direction of the single drive motor 600 is switched between the positive and reverse directions, it is possible to drive both the curl correction unit 510 and the pair of curl correction rollers 85 to rotate simultaneously. Consequently, the overall structure of the curl correction apparatus 500 can be simplified, and reduction to weight, size and cost is enabled. Furthermore, since only the operation of the single drive motor 600 is required, a loss due to power consumption will be low and it is possible to implement a further reduction in power consumption.

Third Embodiment

Next, an image forming apparatus according to a third embodiment of the present invention will be described.

Figure 15:
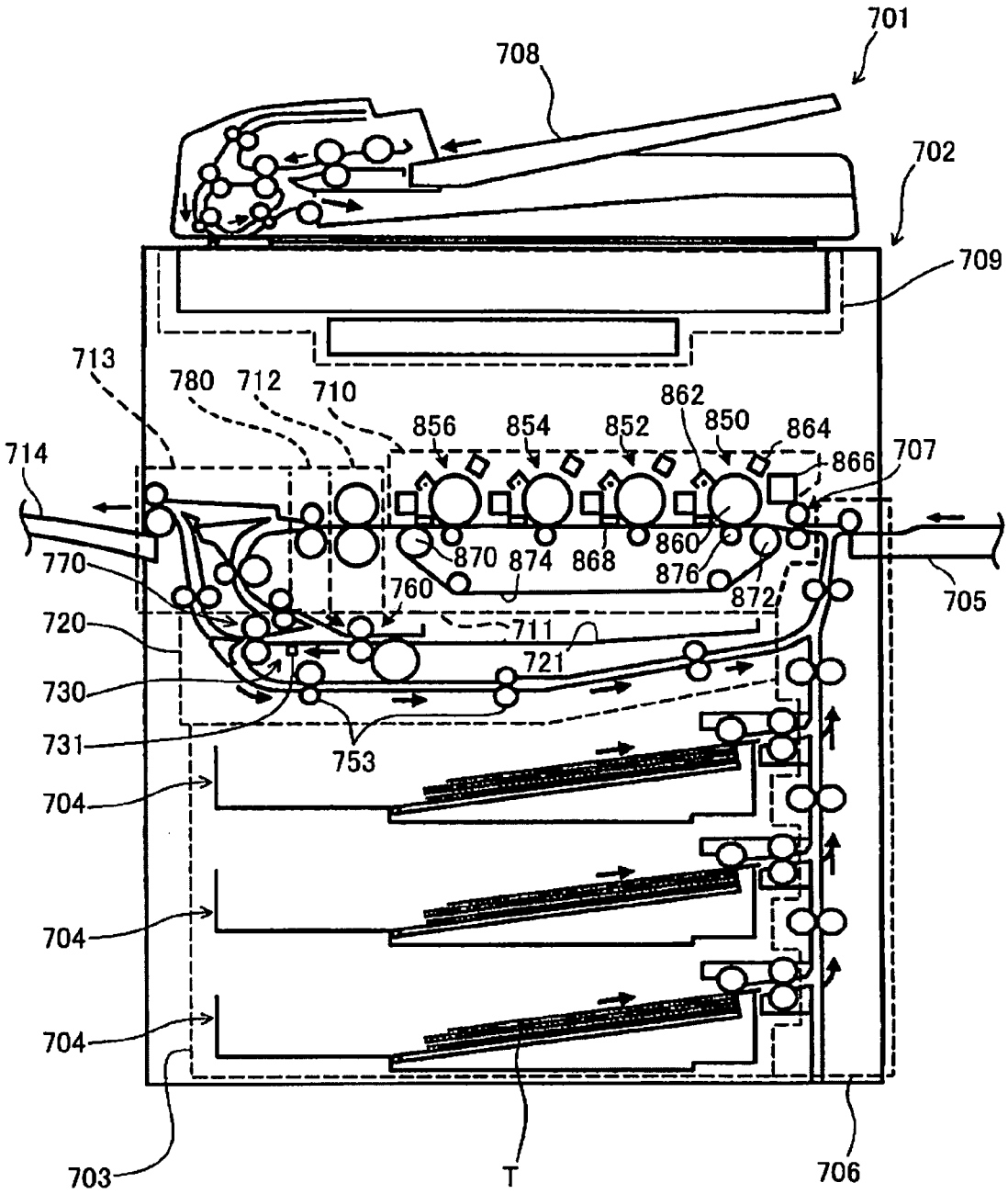
FIG. 15 illustrates the configuration of an image forming apparatus 701 according to a third embodiment of the present invention.

FIG. 15 illustrates the configuration of an image forming apparatus 701 according to a third embodiment of the present invention.

The image forming apparatus 701 is a device that prints an image on a sheet of paper as a printing medium based on image data. The image forming apparatus 701 is a device such as a copying apparatus that includes a copying function for example. The image forming apparatus 701 includes not only the function of printing on one side of a sheet of paper, but also includes a duplex printing function for printing on both front and back sides of a sheet of paper. A solid arrow shown in FIG. 15 indicates a feeding path and a direction of feeding for a sheet of paper.

The image forming apparatus 701 includes a main unit 702 for storing various constituent parts for execution of printing, and a cassette-type paper supply part 703 for containing various sizes of paper in a plurality of paper supply cassettes 704, respectively. The cassette-type document feed part 703 includes for example an upper, middle and lower stage (three stages) of the paper supply cassettes 704. The paper supply cassettes 704 are a so-called front loading type. All individual paper supply cassettes 704 can be drawn out if they are drawn to slide towards the front face of the main unit 702 (the front side of FIG. 15). Sheets of paper such as sheets of cut paper before printing are stored stacked in each paper supply cassette 704. Sheets of paper (denoted by "T" in the figure) stacked in a paper supply cassette 704 is separately fed one at a time from the cassette-type document feed part 703.

Different paper sizes and paper types are set in the upper, middle and lower paper supply cassettes 704, respectively. For example, A4 standard paper which has a relatively high frequency of use is stored in the uppermost paper supply cassette 704, and the uppermost paper supply cassette 704 may be designated as a paper supply stage for normal use. The middle paper supply cassettes 704 may be used for multiple applications, and may store OHP sheets, thick paper, or thin paper. Paper having a size larger than A4 can be stored in the lowermost paper supply cassette 704. The size and type or the like of sheets of paper that are stored in each stage of the paper supply cassettes 704 may be set in advance in the image forming apparatus 701.

In addition, the image forming apparatus 701 includes a manual paper supply part 705. The manual paper supply part 705 is, for example, where sheets of paper differing in type from sheets of paper contained in the paper supply cassettes 704 are manually supplied. Such sheets of paper include a sheet of paper of a size that is not contained in the cassette-type document feed part 703, postcards, or envelopes. In this connection, the manual paper supply part 705 may be configured to be retractable to be stored in the right lateral face of the main unit 702.

The image forming apparatus 701 further includes a paper feed part 706 for feeding the sheets of paper contained in the cassette-type document feed part 703 by picking the sheets of paper one at a time. The paper feed part 706 includes a function of feeding a sheet of paper forwarded from the cassette-type document feed part 703 in a vertical direction along the lateral face of the main unit 702 and feeding the sheet of paper to an image transfer part 711. In addition, the paper feed part 706 includes a function of feeding a sheet of paper forwarded from the manual paper supply part 705 in a horizontal direction, and feeding the sheet of paper to the image transfer part 711.

The image forming apparatus 701 includes resist rollers 707. The resist rollers 707 feed the sheet of paper fed by the paper feed part 706 to a print engine (image forming unit) 710 at predetermined timing. The resist rollers 707 are mounted immediately upstream of the image transfer part 711. The resist rollers 707 have a function of correcting an inclined feeding of a sheet of paper, and feeding the sheet of paper to the image transfer part 711 while synchronizing with a toner image formed in the print engine 710. In the image transfer part 711, a toner image is transferred onto the sheet of paper fed and synchronized by the resist rollers 707.

The image forming apparatus 701 includes a document feed part 708 for mounting a document for reproduction and reading image data, and an optical part 709 for optical reading of the image from the document mounted on the document feed part 708. When a user performs reproduction of a document, the document containing images such as letters, figures or patterns is mounted on the document feed part 708. When the document includes a plurality of sheets of paper, the sheets of paper are separated and fed one at a time by the document feed part 708, and read by the optical part 709.

The image forming apparatus 701 includes the print engine 710 that forms a toner image based on the image data on a sheet of paper, and the image transfer part 711 that transfers the toner image formed by the print engine 710 onto the sheet of paper. The print engine 710 includes a function of forming an electrostatic latent image of the document image based on image data obtained by processing the image read by the optical part 709, and a function of forming a toner image from the electrostatic latent image.

The print engine 710 includes 4-drum tandem image-forming units 850, 852, 854 and 856. These units 850-856 form toner images corresponding to the colors of magenta, cyan, yellow and black in order with respect to the paper feeding direction from upstream to downstream (to the left in FIG. 15).

Each image-forming unit 850-856 includes a photoreceptor drum 860 that rotates in one direction (the clockwise direction in FIG. 15), a charging part 862, an exposure unit 864, a developing unit 866 and a cleaning part 868 disposed along the peripheral surface of the drum 860. In FIG. 15, reference numerals for the charging part 862, the exposure unit 864, and the developing unit 866 are only illustrated in relation to the magenta image forming unit 850. In FIG. 15, reference numerals for the cleaning part 868 are only illustrated in relation to the cyan image-forming unit 852 disposed at proximity downstream of the magenta image forming unit 850. However, the image-forming units 850-856 are composed of the same elements. In respective developing units 866, magenta, cyan, yellow and black toner are contained in corresponding toner boxes (not illustrated).

While the image transfer part 711 revolves a looped transfer belt 874 in one direction (the counterclockwise direction in FIG. 15) to feed a sheet of paper, it transfers the toner images of respective colors onto the transfer surface. The transfer belt 874 goes around a driving roller 870 and a driven roller 872. An upper surface on the outer periphery of the transfer belt 874 comes in contact with a peripheral surface of a photoreceptor drum 860 of each of the four image-forming units 850-856. Four transfer rollers 876 are disposed corresponding to photoreceptor drums 860 on an inner peripheral side of the transfer belt 874. The transfer belt 874 is sandwiched between each transfer roller 876 and each photoreceptor drum 860. A sheet of paper fed from the paper feed part 706 is fed in a downstream direction (the left direction in FIG. 15) while electrostatically adhered to the transfer belt 874. In the feed process described above, toner images corresponding to respective colors are transferred onto a transfer surface of the sheet of paper.

The pair of resist rollers 707 aligns the timing of the image forming operation with the paper feed operation in the print engine 710. The resist rollers 707 rotate in the positive direction synchronously with the rotation of the photoreceptor drum 860 disposed upstream so as to feed a sheet of paper onto the transfer belt 874. Toner images on the photoreceptor drums 860 are transferred onto the sheet of paper as the sheet of paper is fed by the transfer belt 874.

The image forming apparatus 701 includes a fixing part 712 for fixing a non-fixed toner image that has been transferred onto a sheet of paper. The fixing part 712 applies heat and pressure to the sheet of paper that has supported an unfixed toner image in the image transfer part 711 so as to cause this toner image to be fixed.

The image forming apparatus 701 includes an discharging/branch part 713 for discharging or feeding for duplex printing a sheet of paper on which the toner image has been fixed, and an discharging tray 714 on which the sheet of paper discharged by the discharging/branch part 713 is placed. When duplex printing is not executed (when one-side printing is executed), the discharging/branch part 713 discharges the sheet of paper fed from the fixing part 712 without further processing from the discharging/branch part 713 into the discharging tray 714.

The image forming apparatus 701 includes a curl correction apparatus 780 that corrects (decurls) a curl produced in a sheet of paper. The curl correction apparatus 780 is disposed between the fixing part 712 and the discharging/branch part 713 and plays the role of correcting a curl produced in a sheet of paper by causing the sheet of paper to pass through the fixing part 712 and the print engine 710. Details of the curl correction apparatus 780 will be described later making reference to another figure.

The image forming apparatus 701 includes a duplex printing unit 720. The duplex printing unit 720 feeds again a sheet of paper that has been fed from the discharging/branch part 713 for duplex printing to the image transfer part 711. During execution of duplex printing, when the sheet of paper fed from the fixing part 712 is conveyed through the discharging/branch part 713 and the curl direction apparatus 780, the duplex printing unit 720 has a function of switching the feed direction of paper by a paper reversing device 730 provided inside the duplex printing unit 720 and a function of refeeding the sheet of paper to the image transfer part 711 through the paper feed part 706 and the resist rollers 707.

The paper reversing device 730 includes a switch back mechanism 760 and a shift mechanism 770. The switch back mechanism 760 reverses a direction of feeding a sheet of paper. The shift mechanism 770 corrects a displacement in a width direction of a sheet of paper. A sensor 731 for detecting the displacement in the width direction of the sheet of paper is disposed upstream of the shift mechanism 770 with respect to a direction of feeding the sheet of paper.

An intermediate tray 721 is disposed further downstream of the switchback mechanism 760 with respect to a direction of a sheet of paper entering the paper reversing device 730. A sheet of paper, one side of which printing has been performed, is temporarily stored on the intermediate tray 721. The switchback mechanism 760 causes a sheet of paper to be stored temporarily in the intermediate tray 721, and performs a switchback of the sheet of paper so as to switch the direction of paper feeding.

The switch backed sheet of paper undergoes positional correction performed by the shift mechanism 770, and moves downward at a downstream position in the feed direction such that the sheet of paper is reversed. The sheet of paper is fed to the right by a plurality of feed rollers 753 below the print engine 710 and the image transfer part 711, and is then fed upward at a small inclination to merge into the paper feed part 706. In this manner, the sheet of paper is fed to the print engine 710 in the state in which the printed surface is face-down, and printing is performed on both sides of the sheet of paper. The sheet of paper that is duplex printed is discharged to the discharging tray 714 through the curl correction apparatus 780 and the discharging/branch part 713. Alternatively, the sheet of paper is reversed again by the paper reversing device 730, fed upwardly along the left portion of the main unit 702, and discharged to the discharging tray 714.

Figure 16A:
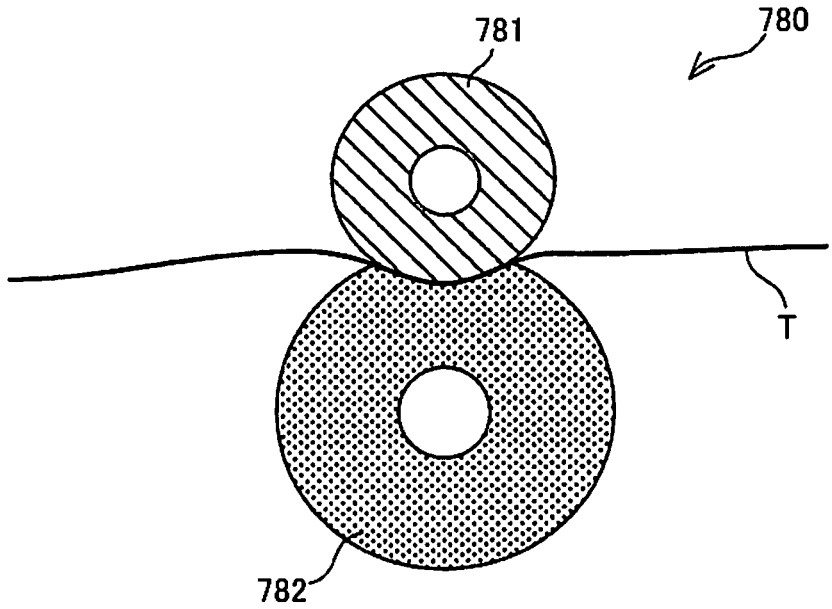
FIG. 16A and FIG. 16B are a schematic view illustrating in detail a curl correction apparatus 780.
Figure 16B:
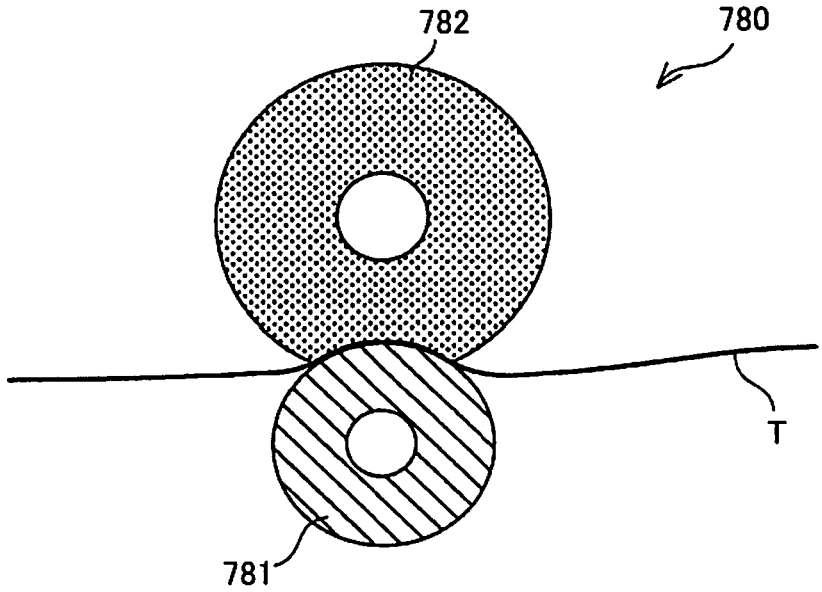

FIG. 16A and FIG. 16B are each a schematic view illustrating the details of the curl correction apparatus 780.

The curl correction apparatus 780 is a rotary decurl device, and includes a hard roller 781 and a soft roller 782.

The hard roller 781 has a hard peripheral surface.

The surface of the soft roller 782 undergoes resilient deformation when pressed by the hard roller 781, and thereby forms a nip with the hard roller 781.

When the hard roller 781 is compared with the soft roller 782 in terms of diameter, the diameter of the soft roller 782 is larger than the diameter of the hard roller 781.

Furthermore, the curl correction apparatus 780 is switchable between a first condition and a second condition.

The first condition indicates a condition as illustrated in FIG. 16A in which the hard roller 781 is disposed above a sheet of paper T and the soft roller 782 is disposed below the sheet of paper T, such that a curl is corrected while the sheet of paper T is curved towards one surface of the sheet of paper T (the back side, the lower side in FIG. 16A and FIG. 16B).

In contrast, the second condition indicates a condition as illustrated in FIG. 16B in which the soft roller 782 is disposed above the sheet of paper T and the hard roller 781 is disposed below the sheet of paper T, such that a curl is corrected while the sheet of paper T is curved towards the other surface of the sheet of paper T (the front side, the upper side in FIG. 16A and FIG. 16B).

The initial state (default state) of the curl correction apparatus 780 is the first condition illustrated in FIG. 16A. The rotation direction of a decurl drive motor that rotates the hard roller 781 and the soft roller 782 is a clockwise direction when viewed from the direction of the motor output shaft. The sheet of paper T passes between the hard roller 781 and the soft roller 782 and is fed from the right to the left in the figure. In the first condition illustrated in FIG. 16A, as a sheet of paper T is oriented to form an upward curl (in the shape of a letter "U"), the sheet of paper T is corrected to be curled upward.

When the curl correction apparatus 780 receives a command to vary the adjustment direction of a curl from an engine control part 950, it stops driving of decurling, and rotates a rotary component not illustrated (rotary control). The rotary component is connected to the hard roller 781 and the soft roller 782. The position of the hard roller 781 and the soft roller 782 is switched from FIG. 16A and FIG. 16B by the rotation of the rotary component.

After completion of the rotation of the rotary component, the decurl drive motor is driven to rotate in a reverse direction in relation to the hard roller 781 and the soft roller 782. The sheet of paper T passes between the hard roller 781 and the soft roller 782 and is fed from the right to the left in the figure. In the second condition illustrated in FIG. 16B, as a sheet of paper T is oriented to form a downward curl (in the shape of an inverted letter "U"), the sheet of paper T is corrected to be curled downward.

In this manner, the curl correction apparatus 780 can switch between the first condition (the configuration illustrated in FIG. 16A) and the second condition (the configuration illustrated in FIG. 16B) by varying the position of the hard roller 781 and the soft roller 782 relative to the sheet of paper.

It may be possible to arbitrarily determine which of the first condition and the second condition is an initial condition depending on the internal configuration of the image forming apparatus 701 or the type of paper. As described above, the initial condition may be the second condition (condition illustrated in FIG. 16B) instead of the first condition (condition in FIG. 16A).

Figure 17:
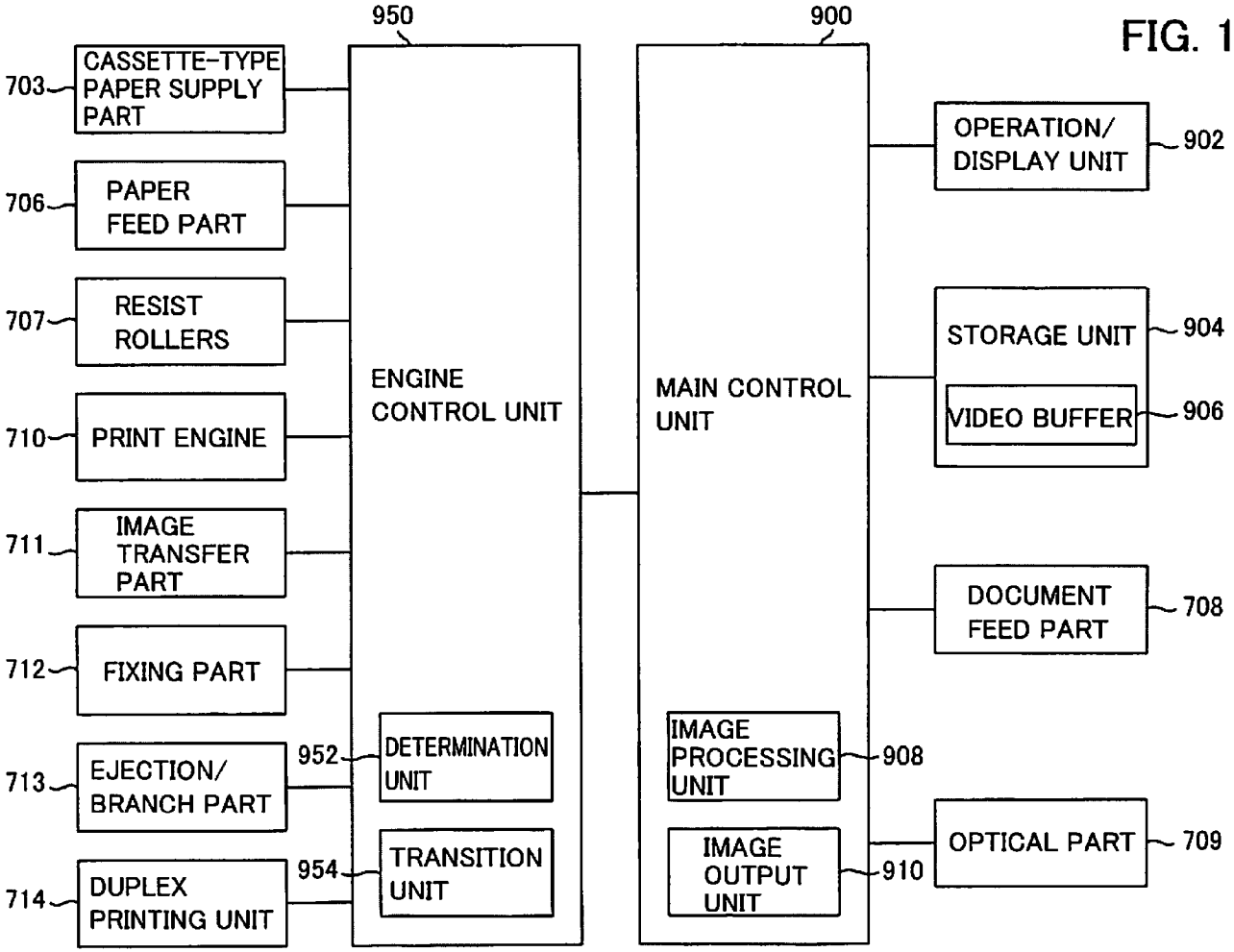
FIG. 17 is a block diagram schematically illustrating the control configuration of an image forming apparatus 701.

FIG. 17 is a block diagram schematically illustrating the control configuration of the image forming apparatus 701.

The image forming apparatus 701 includes a main control unit (main control means) 900 for controlling its overall operation, and an engine control unit (printing control means) 905 for controlling the printing operation executed by the print engine 710. The control units 900 and 950 are each composed of an electronic circuit provided with a central processing unit (CPU). The electronic circuit formed on a circuit board is installed in the image forming apparatus 701. The main control unit 900 and the engine control unit 950 execute processing while exchanging signals.

It may be preferable that the main control unit 900 is configured using Application Specific Integrated Circuits (ASIC). ASIC is a type of electronic component such as an integrated circuit manufactured for a specific application.

In the third embodiment, document feeding operations performed by the document feed part 708 and subsequent image reading operations and the like performed by the optical unit 709 are controlled by the main control unit 900. In addition, image forming operations performed by the print engine 710 are controlled by the engine control unit 950 different from the main control unit 900. In addition to a paper supply operation from the cassette-type paper supply part 703, and the feed operation performed by the paper feed part 706, operations performed by the resist rollers 707, the image transfer part 711, the fixing part 712, the discharging/branch part 713, and the duplex-printing unit 720 are controlled by the engine control unit 950, respectively.

An operation/display unit 902 and a storage part 904 are connected to the main control unit 900. Although not illustrated in FIG. 15, the operation/display unit 902 is provided on an upper surface of the main unit 702 and in front of the document feed part 708 when viewed by a user. The operation/display unit 902 includes a touch panel in addition to operation keys. In addition to operations through the operation keys, the operation/display unit 902 accepts touch operations via the display screen performed by a user, and displays text information and the like to notify the user of paper jams. The storage unit 904 for example includes a large capacity storage device (hard disk) or a storage device (ROM, RAM). The image read by the optical part 709 is temporarily stored in a video buffer (image data storage means) 906 of the storage unit 904 in a predetermined data format prior to being sent to the engine control part 950.

In addition, the main control unit 900 includes an image processing unit (calculation means) 908 and an image output unit 910.

The image processing unit 908 calculates a coverage rate of a front surface of a sheet of paper and another coverage rate of a reverse surface of the sheet of paper based on the image data temporarily stored in the video buffer 906 prior to formation of an image performed by the print engine 710.

The image output unit 910 executes transmission processing of the image data temporarily stored in the video buffer 906 in response to a request sent from the engine control unit 950.

The engine control unit 950 includes a determination unit (determination means) 952 and a switching unit (switching means) 954.

The determination unit 952 determines to switch the curl correction apparatus 780 to one of the first condition and the second condition based on the coverage rate of the front surface and the reverse surface calculated by the image processing unit 908 prior to image formation performed by the print engine 710.

The switching unit 954 switches the curl correction apparatus 780 to one of the first condition and the second condition based on a result determined by the determination unit 952 prior to image formation performed by the print engine 710 (see FIG. 16A and FIG. 16B).

In the image forming apparatus 701, data that is set by the operation through the operation/display unit 902 for respective jobs is stored in the storage unit 904 through the main control unit 900. The data described above includes various types of setting related to paper size, paper type, paper feed direction, duplex or one-side printing formation, document density, frame deletion, binding margin, 4 in 1 processing, and the like. Image processing is executed by the main control unit 900 in response to the respective types of setting. The time required for image processing performed by the image forming apparatus 701 depends on setting details. An application program for a multifunction machine that performs multi-thread processing is stored in the storage unit 904.

The main control unit 900 and the engine control unit 950 control the image forming operation (printing operation) in accordance with a predetermined sequence while exchanging signals. For example, during image processing for reproduction of a document, the following processing is executed in response to a user pressing a start key (not illustrated) of the operation/display unit 902 when the document is mounted on the document feed part 708.

Firstly, when a paper sensor (not illustrated) installed in the document feed part 708 detects documents, the documents is fed sheet by sheet by the document feed part 708, and during the feeding process, images of the documents are scanned by the optical part 709. The image data read at this time is stored in the video buffer 906 of the storage unit 904 via the main control unit 900. The main control unit 900 sends the image data to the engine control unit 950 after executing preprocessing such as noise removal of an image for the image data.

The engine control unit 950 executes image processing for the image data sent from the main control unit 900 according to the various types of setting, and then causes the print engine 710 to form an image based on image data corresponding to each page. In this manner, an electrostatic latent image is formed on a surface of each photoreceptor drum 860 of the print engine 710. The electrostatic latent image is developed by use of the toner image.

On the other hand inside the image forming apparatus 701, a sheet of paper that has been discharged from the cassette-type paper supply part 703 is fed to and temporarily held in the resist rollers 707. In conjunction with the image forming operation by the print engine 710, at timing when the photoreceptor drum 860 in the most upstream position is rotated to a predetermined angle, the sheet of paper is fed again by the resist rollers 707. In this manner, a toner image for each separate color is transferred in sequence onto the sheet of paper. Other three photoreceptor drums 860 that are positioned downstream are each adjusted to a rotation angle that is synchronized to the feeding speed of the sheet of paper.

When duplex-printing is set for the current job, the sheet of paper on which atoner image is transferred passes through the fixing part 712 where heat and pressure is applied to the sheet of paper, and passes through the curl correction apparatus 780. Thereafter, the sheet of paper is branched downward in the discharging/branch part 713 and is fed toward the duplex-printing unit 720.

The above description is related to the basic configuration and operation of the image forming apparatus 701 according to the third embodiment. In addition, in the third embodiment, when a user designates duplex printing and a multiple number of runs in a job, the following operations are executed between the main control unit 900 and the engine control unit 950. Several examples of working examples performed between the main control unit 900 and the engine control unit 950 (sequence pattern) will be described below.

Working Example 1

Figure 18:
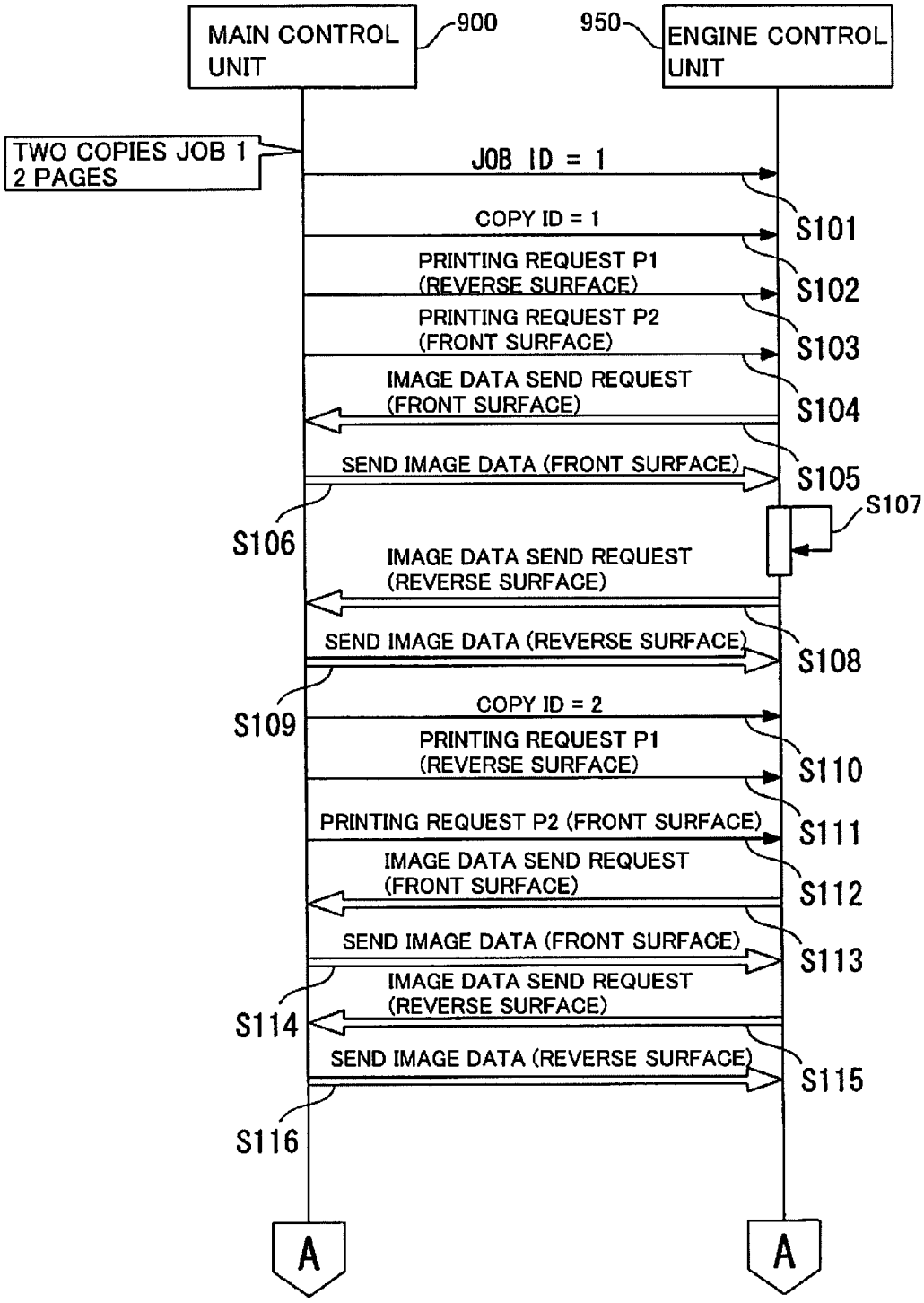
FIG. 18 illustrates the sequence of operations in Working Example 1 (1/2)
Figure 19:
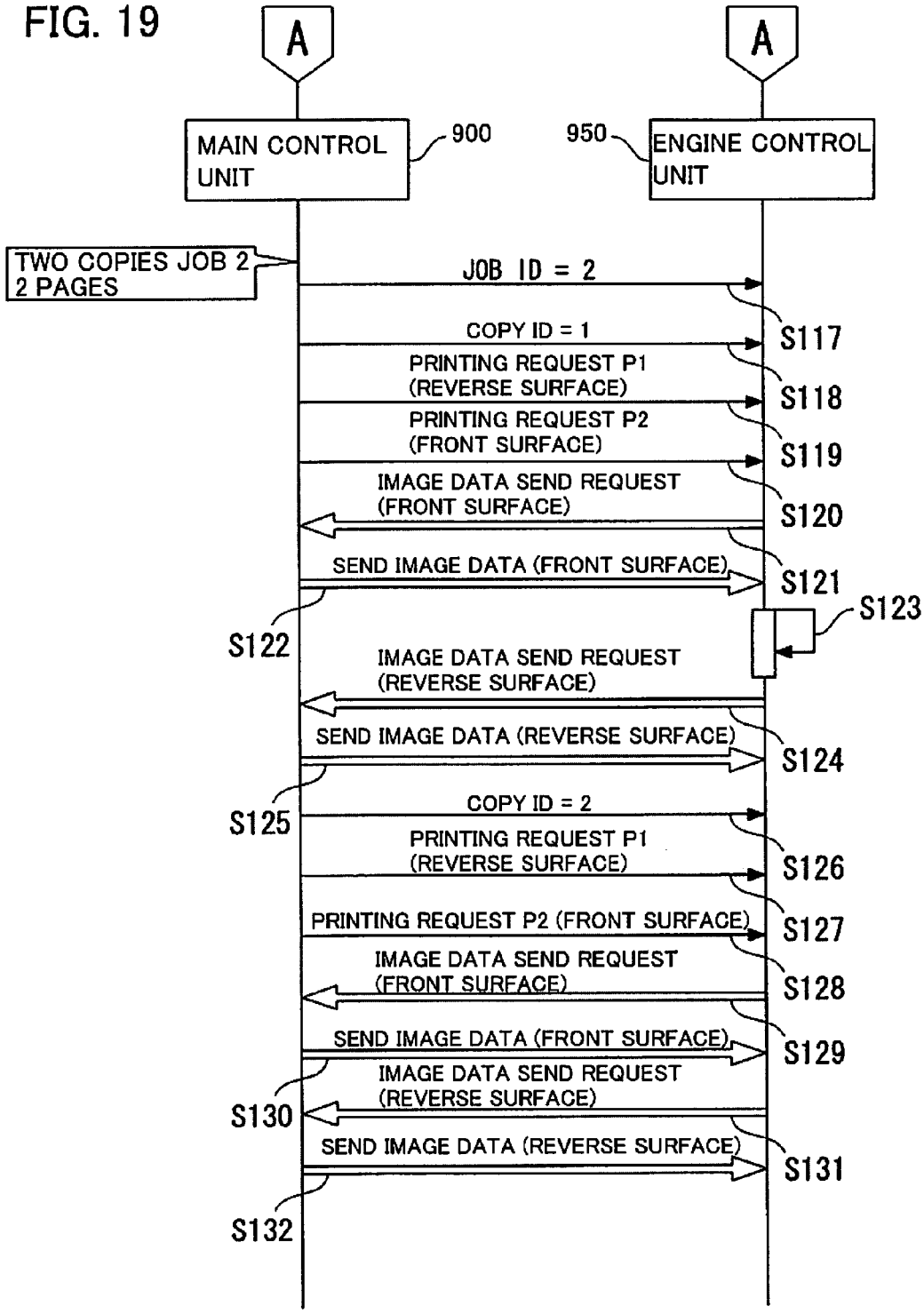
FIG. 19 illustrates the sequence of operations in Working Example 1 (2/2)

FIG. 18 and FIG. 19 illustrate the sequence of operations in a Working Example 1.

Working Example 1 is an example in which sheets of paper are continuously supplied from the same paper feed cassette 704, and duplex printing is executed on the sheets of paper. Working example 1 is an example of the sequence assumed for a case when a user requests two jobs (JOB1 and JOB2).

Specific job details are: JOB1 requests two runs for two pages of original documents (since duplex printing is performed, the number of sheets actually used is one for each run). In the same manner as JOB1, JOB2 requests two runs for two pages of original documents.

First Copy in First Job (JOB1)

For example, in a job for reproduction of a document, a user instructs duplex printing and two runs through the operation/display unit 902, and presses a start key. In response to this operation, the main control unit 900 causes the optical part 709 to read an image surface of a document and causes the image data to be stored in the video buffer 906 of the storage unit 904, while the main control unit 900 causes the document feed part 708 to feed the document automatically.

During processing described above, the image processing unit 908 of the main control unit 900 calculates a coverage rate of a front surface of a sheet of paper and a coverage rate of a reverse surface of the sheet of paper based on the image data temporarily stored in the video buffer 906. The coverage rates of the front surface and the reverse surface can be calculated by counting dots of the image data in the video buffer 906.

Step S101: The main control part 900 sends a job ID (job information) indicating a printing job unit to the engine control part 950. More specifically, the JOBID=1, and shows that this job is the first job.

Step S102: The main control unit 900 sends a COPY ID that is information related to the number of runs of printing (print run number information) to the engine control unit 950. More specifically, COPY ID=1 shows that the printing is the first copy.

Step S103, S104: The main control unit 900 sends a printing instruction for requesting printing of an image by a page unit on both surfaces of the sheet of paper (printing instruction) and coverage rate to the engine control unit 950. More specifically, it includes a printing instruction for the reverse surface of page 1 (P1) and a coverage rate for the reverse surface of page 1 (P1), and a printing instruction for the front surface of page 1 (P2) and a coverage rate for the front surface of page 1 (P2). The printing instruction and the coverage rate for the reverse surface are initially sent from the main control unit 900 to the engine control unit 950, and then the printing instruction and the coverage rate for the front surface are sent.

The printing instruction includes a sheet number (which page of sheets), information identifying the front and reverse surfaces, and information related to a source feeding a sheet of paper and a discharging destination after printing. For example, the printing instruction for the back surface includes information related to paper supply from the upper stage of the paper feed cassette 704, and designation of the intermediate tray 721 as the discharging destination after printing. The engine control unit 950 specifies the paper supply cassette 704 (paper supply means) to perform actual paper supply, and controls switching of the discharging destination after printing.

The engine control unit 950 controls each unit of the print engine 710 in response to the printing instruction, and places the image-forming units 850-856 in a standby state enabling image formation.

Step S105: The engine control unit 950 sends an image data send instruction related to the front surface of the sheet of paper to the main control unit 900 (PVSYNC: synchronizing signal). The image data send instruction requests sending (transfer) of the image data temporarily stored in the video buffer 906 from the main control unit 900 to the engine control unit 950.

Step S106: The image output unit 910 of the main control unit 900 receives the image data send instruction, and sends the image data for the front surface of the sheet of paper from the video buffer 906 to the engine control unit 950.

Step S107: The determination unit 952 and the switching unit 954 of the engine control unit 950 execute switching of the decurl direction (curl correction direction). The switching process of the decurl direction determines the direction of decurl executed by the curl correction apparatus 780 based on the coverage rate sent from the main control unit 900, and switches the curl correction apparatus 780 to one of the first condition and the second condition (FIG. 16A and FIG. 16B) based on the determination result. This determination is performed by a comparison of the coverage rates between the front surface and the reverse surface. With this determination, a direction is predicted in which the sheet of paper after printing will be curled. It is possible to implement the prediction based on an amount of coverage rate or by setting a predetermined threshold. When the initial configuration of the curl correction apparatus 780 is the first condition, and the determination result is to switch to the first condition, there is no need to vary the configuration of the curl correction apparatus 780.

The switching process for the decurl direction (step S107) is placed between the sending process for image data sent from the main control unit 900 (step S106) and the image data requesting process performed by the engine control unit 950 to be described later (step S108). Accordingly, it is possible to establish an interval between formation of images and perform smoothly the decurl direction switching process.

It is adequate for the switching process for the decurl direction in the step S107 to be executed prior to completion of sending all the image data send instructions related to the front surface and the reverse surface of the sheet of paper performed by the engine control unit 950. For example, it may be executed at a step before processing step S105.

Step S108: The engine control unit 950 sends an image data send instruction (PVSYNC) related to the reverse surface of the sheet of paper to the main control unit 900.

Step S109: The image output unit 910 of the main control unit 900 receives the image data send instruction, and sends image data related to the reverse surface of the sheet of paper from the video buffer 906 to the engine control unit 950.

Upon receipt of the image data, the engine control unit 950 operates the print engine 710 and causes each of the image-forming units 850-856 to form a toner image based on the image data for each separate color. Next, the engine control unit 950 causes the image transfer part 711 to transfer the toner image on each photoreceptor drum 860 onto the sheet of paper. The sheet of paper on which a full color toner image transferred is pressured and heated while passing through the fixing part 712, and is discharged to the discharging tray 714 via the discharging/branch part 713. After duplex printing of the sheet of paper is performed, the curl correction apparatus 780 that is switched to an appropriate condition executes accurate decurl processing.

The sequence to this point completes printing process for a first copy. The engine control unit 950 then commences print operations for a second copy.

Second Copy in First Job (JOB1)

Step S110: The main control part 900 sends a COPY ID to the engine control part 950. More specifically, COPY ID=2 shows that this copy is the printing of the second copy.

Step S111, S112: The main control unit 900 sends a printing instruction to the engine control unit 950. More specifically, a printing instruction for a reverse surface of the first page and a printing instruction for the front surface of the second page is required. It is not necessary to send the coverage rate during printing processing for the second copy. This is due to the fact that the coverage rate of the first copy is the same as the coverage rate of the second copy. The engine control unit 950 controls the printing operation for the second copy and subsequent copies based on the coverage rate of the first copy.

Step S113: The engine control unit 950 sends an image data send instruction (PVSYNC) related to the front surface of the sheet of paper to the main control unit 900.

Step S114: The image output unit 910 of the main control unit 900 sends image data related to the front surface of the sheet of paper to the engine control unit 950.

Step S115: The engine control unit 950 sends an image data send instruction (PVSYNC) related to the reverse surface of the sheet of paper to the main control unit 900.

Step S116: Upon receipt of the image data send instruction, the image output unit 910 of the main control unit 900 sends image data related to the reverse surface of the sheet of paper from the video buffer 906 to the engine control unit 950.

Since the contents of printing of the first copy and the second copy are the same, the relevant coverage rate is the same. Furthermore decurl processing by the curl correction apparatus 780 is also the same. As a result, printing of the second copy may be executed while the condition (first condition or second condition) of the curl correction apparatus 780 having been driven for the first copy is maintained.

When processing for the first job (JOB1) is completed, processing for the second job (JOB2) as illustrated in FIG. 19 is performed (connection denotation A→A).

First Copy of Second Job (JOB2)

The process for the second job (JOB2) is basically the same as the processing of the first job (JOB1) described above, and accordingly a brief description will be provided. During execution of the first job (JOB1), the second job (JOB2) can be reserved by a user through the operation/display unit 902. Alternatively, the user may instruct the execution of the second job (JOB2) after completion of the first job (JOB1) through the operation/display unit 902.

Step S117: The main control unit 900 sends a job ID (JOBID=2) to the engine control unit 950.

Step S118: The main control unit 900 sends a copy ID (COPY ID=1) to the engine control unit 950.

Step S119, S120: The main control unit 900 sends an instruction of duplex printing and coverage rates for the front and reverse surface of a sheet of paper to the engine control unit 950.

Step S121: The engine control unit 950 sends an image data send instruction (PVSYNC) related to the front surface of the sheet of paper to the main control unit 900.

Step S122: The image output unit 910 of the main control unit 900 sends image data related to the front surface of the sheet of paper to the engine control unit 950.

Step S123: The engine control unit 950 performs switching of the decurl direction. The switching processing of the decurl direction is a process of whether or not to switch the curl correction apparatus 780 from the first condition to the second condition. The contents of processing are the same as the first job (JOB1).

Step S124: The engine control unit 950 sends an image data send instruction (PVSYNC) related to the reverse surface of the sheet of paper to the main control unit 900.

Step S125: The image output unit 910 of the main control unit 900 sends image data related to the reverse surface of the sheet of paper to the engine control unit 950.

Second Copy of Second Job (JOB2)

Step S126: The main control unit 900 sends a copy ID (COPY ID=2) to the engine control unit 950.

Step S127, S128: The main control unit 900 sends a printing instruction to the engine control unit 950.

Step S129: The engine control unit 950 sends an image data send instruction (PVSYNC) related to the front surface of the sheet of paper to the main control unit 900.

Step S130: The image output unit 910 of the main control unit 900 sends image data related to the front surface of the sheet of paper to the engine control unit 950.

Step S131: The engine control unit 950 sends an image data send instruction (PVSYNC) related to the reverse surface of the sheet of paper to the main control unit 900.

Step S132: The image output unit 910 of the main control unit 900 sends image data in related to the reverse surface of the sheet of paper to the engine control unit 950.

Since the contents of printing of the second copy and the first copy in the second job (JOB2) are the same, the same coverage rate and same decurl processing are used. As a result, printing of the second copy may be executed without changing the condition (first condition or second condition) of the curl correction apparatus 780 having been driven for the first copy.

These processes complete the second job (JOB2).

As described above, in the Working Example 1, the image processing unit 908 of the main control unit 900 calculates the coverage rate prior to the print engine 720 forming an image in either the first job or the second job. Based on a result provided by the determination unit 952 of the engine control unit 950 that judges the switching condition of the curl correction apparatus 780, the switching unit 954 of the control unit 950 switches the curl correction apparatus 780 to one of the first condition and the second condition. As a result, even when two copies are printed, print processing can be performed with accurate decurl processing from the first copy. Therefore, there is no need for the first copy to be output as a sample, and printing with improved printing quality is enabled from printing of the first copy.

Working Example 2

Figure 20:
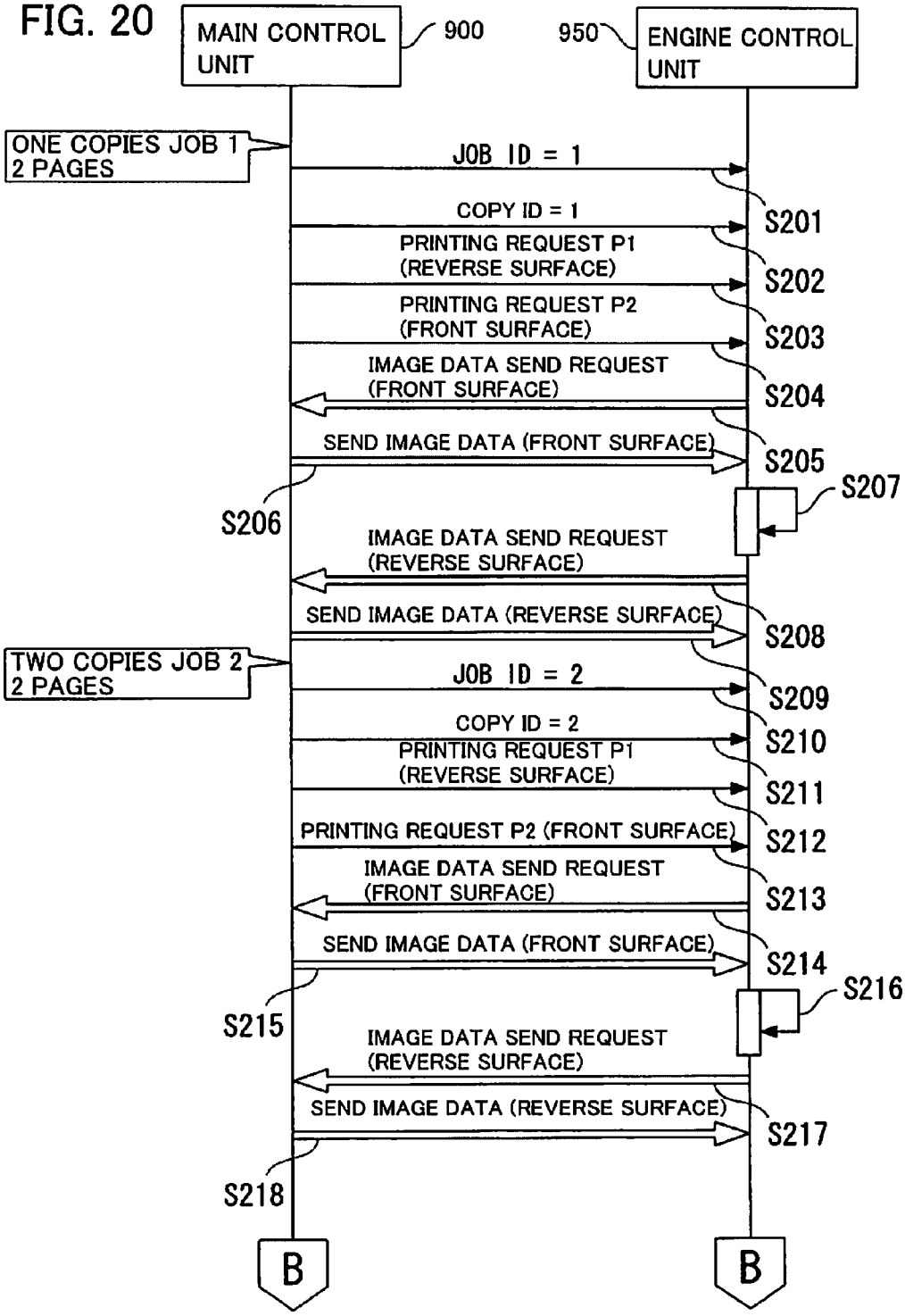
FIG. 20 illustrates the sequence of operations in Working Example 2 (1/2)
Figure 21:
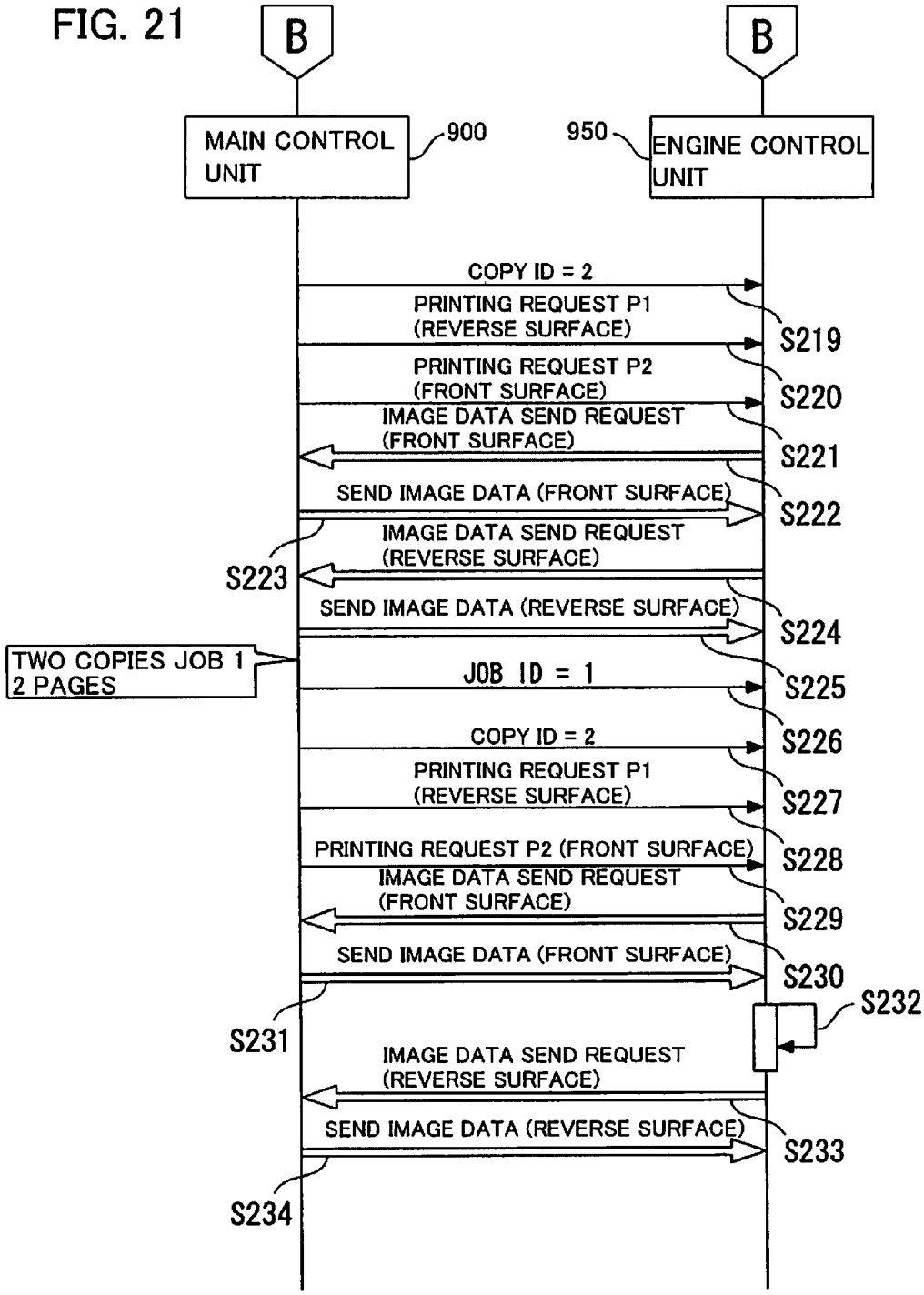
FIG. 21 illustrates the sequence of operations in Working Example 2 (2/2).

FIG. 20 and FIG. 21 illustrate the sequence of operations in Working Example 2.

In Working Example 2, it is assumed as follows: A user requests two jobs (JOB1 and JOB2) in the same manner as Working Example 1. When the printing of the first copy of the first job (JOB1) is completed, an interrupt processing for the second job (JOB2) comes in. The print processing of the second copy of the first job (JOB1) is resumed after the print processing of the second job (JOB2) is completed. In the following description, description that overlaps with those features that are common to Working Example 1 above will be omitted as suitable.

First Copy of First Job (JOB1)

In a job for reproduction of a document, a user instructs printing of two copies in duplex printing mode through the operation/display unit 902, and presses the start key. In response to this operation, the main control unit 900 causes the document feed part 708 to automatically feed documents and causes the optical part 709 to read an image surface of a document. The main control unit 900 causes the image data to be stored in the video buffer 906 of the storage unit 904. At this time, the image processing unit 908 of the main control unit 900 calculates coverage rates of a reverse surface and a front surface of the sheet of paper based on the image data temporarily stored in the video buffer 906.

Step S201: The main control part 900 sends a job ID (JOBID=1) to the engine control part 950.

Step S202: The main control unit 900 sends a copy ID (COPY ID=1) to the engine control unit 950.

Step S203, S204: The main control unit 900 sends printing instructions for requesting printing and coverage rates to the engine control unit 950. More specifically, the printing instructions and the coverage rates include a printing instruction and a coverage rate of the reverse surface of the first page, and a printing instruction and a coverage rate for the front surface of the second page.

Step S205: The engine control unit 950 sends an image data send instruction (PVSYNC) related to the front surface of the sheet of paper to the main control unit 900.

Step S206: The image output unit 910 of the main control unit 900 receives the image data send instruction, and sends image data related to the front surface of the sheet of paper from the video buffer 906 to the engine control unit 950.

Step S207: The engine control unit 950 executes a switching of the decurl direction. The switching operation of the decurl direction is the same process as Working Example 1.

Step S208: The engine control unit 950 sends an image data send instruction (PVSYNC) related to the reverse surface of the sheet of paper to the main control unit 900.

Step S209: The image output unit 910 of the main control unit 900 receives the image data send instruction, and sends image data related to the reverse surface of the sheet of paper from the video buffer 906 to the engine control unit 950.

These processes complete printing of the first copy for the first job (JOB1). For a case of standard processing, the process proceeds to printing of a second copy of the first job (JOB1). In the present case, it is assumed that the second job (JOB2) comes in as an interruption.

Upon receipt of the interruption, the engine control unit 950 temporarily suspends the first job (JOB1), and causes the information related to the coverage rate and the condition of the curl correction apparatus 780 during printing of the current job to be stored in a memory (not illustrated) or the like. On the other hand, the image processing unit 908 of the main control unit 900 calculates coverage rates of the front and reverse surface related to the second job (JOB2).

First Copy of Second Job (JOB2)

Step S210: The main control part 900 sends a job ID (JOBID=2) to the engine control part 950.

Step S211: The main control unit 900 sends a copy ID (COPY ID=1) to the engine control unit 950.

Step S212, S213: The main control unit 900 sends printing instructions for duplex printing and coverage rates of the front and reverse surfaces of the sheet of paper to the engine control unit 950.

Step S214: The engine control unit 950 sends an image data send instruction (PVSYNC) related to the front surface of the sheet of paper to the main control unit 900.

Step S215: The image output unit 910 of the main control unit 900 sends image data related to the front surface of the sheet of paper to the engine control unit 950.

Step S216: The engine control unit 950 executes switching of the decurl direction. The switching operation of the decurl direction is the same process as Working Example 1.

Step S217: The engine control unit 950 sends an image data send instruction (PVSYNC) related to the reverse surface of the sheet of paper to the main control unit 900.

Step S218: The image output unit 910 of the main control unit 900 sends image data related to the reverse surface of the sheet of paper to the engine control unit 950.

Second Copy of Second Job (JOB2)

Turning now to FIG. 21 (connection denotation B→B), in Step S219: The main control part 900 sends a copy ID (COPY ID=2) to the engine control part 950.

Step S220, S221: The main control unit 900 sends a printing instruction for the front and reverse surfaces of the page to the engine control unit 950.

Step S222: The engine control unit 950 sends an image data send instruction (PVSYNC) related to the front surface of the sheet of paper to the main control unit 900.

Step S223: The image output unit 910 of the main control unit 900 sends image data related to the front surface of the sheet of paper to the engine control unit 950.

Step S224: The engine control unit 950 sends an image data send instruction (PVSYNC) related to the reverse surface of the sheet of paper to the main control unit 900.

Step S225: The image output unit 910 of the main control unit 900 sends image data related to the reverse surface of the sheet of paper to the engine control unit 950.

In the printing processing of the second copy of the second job (JOB2), since switching of the decurl direction is already performed in the printing processing of the first copy of the second job (JOB2), switching of the decurl direction is not performed. This is due to the fact that the sheet of paper curls in the same direction in the printing processing between the first copy and the second copy. As a result, printing of the second copy is allowed to maintain the condition of the curl correcting apparatus 780 for the first copy. This feature is the same as Working Example 1.

These processes complete the second job (JOB2).

Second Copy of First Job (JOB1)

The engine control unit 950 executes the printing for the second job (JOB2) by an interrupt, reads information related to the coverage rate stored during the interrupt and the condition of the curl correction apparatus 780 from the memory or the like, and then resumes the printing processing of the suspended second copy of the first job (JOB1).

Step S226: The main control part 900 sends a job ID (JOBID=2) to the engine control part 950.

Step S227: The main control unit 900 sends a copy ID (COPY ID=1) to the engine control unit 950.

The engine control unit 950 determines that the printing processing of the second copy of the first job (JOB1) shall be resumed based on these two IDs.

Step S228, S229: The main control unit 900 sends a printing instruction for the front and reverse surfaces of the page to the engine control unit 950.

Step S230: The engine control unit 950 sends an image data send instruction (PVSYNC) related to the front surface of the sheet of paper to the main control unit 900.

Step S231: The image output unit 910 of the main control unit 900 sends image data related to the front surface of the sheet of paper to the engine control unit 950.

Step S232: The engine control unit 950 switches the decurl direction. In the printing processing of the second copy of the first job (JOB1), since the switching process for the decurl direction is already performed in the printing processing of the first copy of the first job (JOB1), switching of the decurl direction is not performed normally. However in the present working example, the second job (JOB2) is executed as an interruption. Consequently, due to the possibility of the decurl direction being switched during the second job (JOB2), it may be necessary that switching of the decurl direction is performed again.

However, it is not necessary for the engine control unit 950 to cause the main control unit 900 to recalculate the coverage rate. After the engine control unit 950 performs printing according to interruption of the second job (JOB2) the engine control unit 950 reads the stored information related to the coverage rate and the condition of the curl correction apparatus 780 from the memory or the like and executes switching of the decurl direction. Subsequently, the engine control unit 950 executes printing processing of the suspended second copy of the first job (JOB1).

Step S233: The engine control unit 950 sends an image data send instruction (PVSYNC) related to the reverse surface of the sheet of paper to the main control unit 900.

Step S234: The image output unit 910 of the main control unit 900 sends image data related to the reverse surface of the sheet of paper to the engine control unit 950.

These processes complete the first job (JOB1).

In Working Example 2 described above, when receiving the second job (JOB2) as an interruption, information related to the coverage rate and the condition of the curl correction apparatus during execution of printing of the first job (JOB1) is stored, and the suspended printing operation is resumed using the stored information. As a result, when printing is recommenced, printing can be recommenced in the state prior to suspension, and there is no need to recalculate the coverage rate related to the job prior to suspension. After recommencing printing, printing processing can be continued in the state prior to suspension, and therefore the efficiency of printing operations can be increased.

A preferred embodiment of the present invention has been described above; however, the present invention is not limited thereto and can be carried out in various modes.

For example, in the first embodiment as described above, although both roller drive motor 530 and the unit drive motor 540 are disposed on one end (Y1 side) in the axial direction Y of the pair of curl correction rollers 85 in the curl correction unit 510, the invention is not limited in this regard. Both drive motors 530, 540 may be disposed separately onto both ends in the axial direction Y (Y1 side, Y2 side).

The roller drive motor may drive both hard roller 85*b* and the soft roller 85*a*, or may drive only the soft roller 85*a*.

In substitution for the outer gear 514 in the curl correction apparatus 500 according to the first embodiment, for example, it may be possible that the supporting member 512 has gear teeth formed on its peripheral surface to be used as an outer gear. In this case, the first actuator is connected to the peripheral surface of the supporting member 512. According to this configuration, the first actuator can directly transmit a driving force to the supporting member 512. Therefore, the supporting member 512 rotates accompanying the operation of the first actuator and it is possible to suitably switch the direction of curl correction.

The contents of the job described in each working example in the third embodiment are merely preferred examples, and the present invention may be applied to other types of job. In addition to the operation performed by a user through the operation/display unit 902, the execution of the job may be performed by signals transmitted from a computer connected to a network.

In addition, the configuration of each portion of the image forming apparatus 701 is a preferred example, and the invention may be used by suitably modifying the configuration.

The sheet is not limited to a sheet of paper, and for example may be a sheet of film.

The present invention is not limited to a copying machine 1, but may be applied to an image forming apparatus such as a multifunction peripheral (MFP) used in a network environment, or a printer, facsimile, or a composite machine incorporating such devices. The present invention may be applied to an apparatus other than an image forming apparatus.

What is claimed is:

1. An image forming apparatus that comprises an image forming unit for forming an image based on image data processed per page, the image forming apparatus printing an image formed in the image forming unit per page on one surface of a sheet of paper and another image per page on another surface of the same sheet of paper and discharging the sheet of paper, the image forming apparatus comprising:

a curl correction apparatus for correcting a curl produced in the sheet of paper on which the images are formed by the image forming unit, the curl correction apparatus configured to be switchable between a first condition in which curl is corrected by curving the sheet of paper towards the one surface of the sheet of paper and a second condition in which curl is corrected by curving the sheet of paper towards the other surface of the sheet of paper;

a calculation unit for calculating a coverage rate for the one surface of the sheet of paper and a coverage rate for the other surface of the sheet of paper by counting dots in the image data prior to the image forming unit forming an image;

a determination unit for determining whether to switch the curl correction apparatus to the first condition or to the second condition based on the coverage rate calculated by the calculation unit prior to the image forming unit forming an image;

a switching unit for switching the curl correction apparatus between the first condition and the second condition based on a result of determination determined by the determination unit prior to the image forming unit forming an image;

a main control unit for controlling overall operation of the image forming apparatus;

a printing control unit for controlling printing operation executed by the image forming unit; and an image data storage unit for temporarily storing the image data that is to be sent to the image forming unit, wherein the calculation unit is disposed in the main control unit, wherein the determination unit and the switching unit are disposed in the printing control unit, wherein the main control unit transmits a printing instruction to indicate printing of an image per page for each surface of the sheet of paper, and the coverage rate calculated by the calculation unit to the printing control unit, wherein the calculation unit calculates the coverage rate based on the image data stored in the image data storage unit, wherein the printing control unit transmits an image data send instruction for requesting to send the image data temporarily stored in the image data storage unit to the main control unit based on the printing instruction, and wherein the determination unit executes the determination prior to the printing control unit completing sending of all image data send instructions related to the one surface and the other surface of the sheet of paper.

2. The image forming apparatus according to claim 1, wherein the main control unit transmits print run information related to a number of copies of printed matter to the printing control unit; and wherein when the print run information indicates at least two copies, the printing control unit controls printing operation for a second copy and subsequent copies based on a coverage rate of a first copy.

3. The image forming apparatus according to claim 1, wherein the main control unit transmits job information related to a printing job unit to the printing control unit, and wherein when another job information is received by interruption during execution of printing, the printing control unit temporarily suspends a job in progress and stores information about a coverage rate and a condition of the curl correction apparatus related to the job in progress, so that the printing control unit resumes the suspended job based on the stored information related to the coverage rate and the condition of the curl correction apparatus after executing printing based on the other job information.

* * * * *